US006971951B2

(12) United States Patent
Boyer

(10) Patent No.: US 6,971,951 B2
(45) Date of Patent: Dec. 6, 2005

(54) POWER TOOL WITH PORTABLE POWER SOURCE

(75) Inventor: Christopher T. Boyer, Oak Park, IL (US)

(73) Assignee: WMH Tool Group, Inc., Elgin, IL (US)

( * ) Notice: Subject to any disclaimer, the term of this patent is extended or adjusted under 35 U.S.C. 154(b) by 0 days.

(21) Appl. No.: 10/247,209

(22) Filed: Sep. 19, 2002

(65) Prior Publication Data

US 2004/0058632 A1 Mar. 25, 2004

(51) Int. Cl.[7] ..... B24B 23/00
(52) U.S. Cl. ..... 451/344; 451/357
(58) Field of Search ..... 451/344, 357; 15/143.1; 307/126, 150, 80; 409/181, 182; 173/170, 217; 16/430; 408/124

(56) References Cited

U.S. PATENT DOCUMENTS

| | | | | |
|---|---|---|---|---|
| 1,394,564 A | * | 10/1921 | Lindgren | 30/477 |
| 2,597,971 A | | 5/1952 | Burnham | |
| D205,758 S | | 9/1966 | Storm, Jr. | |
| 3,531,812 A | | 10/1970 | Bailey et al. | |
| 3,733,634 A | | 5/1973 | Golbe | |
| 3,952,239 A | * | 4/1976 | Owings et al. | 320/113 |
| 4,102,084 A | | 7/1978 | Bloomquist | |
| D254,231 S | | 2/1980 | Burglin et al. | |
| 4,188,682 A | | 2/1980 | Burglin et al. | |
| 4,330,967 A | * | 5/1982 | Richardson | 451/451 |
| D264,797 S | | 6/1982 | Burglin et al. | |
| D273,079 S | | 3/1984 | Ibaraki | |
| D283,590 S | | 4/1986 | Ibaraki | |
| D295,253 S | | 4/1988 | Ashworth | |
| 4,747,733 A | | 5/1988 | Akazawa | |
| 4,791,694 A | | 12/1988 | Itaya et al. | |
| 4,879,847 A | | 11/1989 | Butzen et al. | |

(Continued)

FOREIGN PATENT DOCUMENTS

DE 200 09 624 U1 8/2000

(Continued)

OTHER PUBLICATIONS

Materials from id-usa.com Internet website, 5pp. (no date of publication); and.

(Continued)

*Primary Examiner*—David B. Thomas
(74) *Attorney, Agent, or Firm*—Fitch, Even, Tabin & Flannery

(57) ABSTRACT

A power tool in accordance with the invention includes a housing having an internal compartment with a motor therein, a handle connected to the housing for maneuvering the power tool, a working element connected to and driven by the motor to work on a workpiece, and a removable, portable power source having a first position wherein the power source is located primarily in the internal compartment of the housing and being electrically connected to the motor to provide power to the motor for driving the working element and a second position wherein the power source is located remotely from the housing and detached electrically from the motor. A preferred embodiment of the tool also includes a lock associated with the apparatus which has a lock position that prevents the removable, portable power source from unintentionally becoming separated from the power tool, and an unlock position that enables the removable portable power source to be selectively removed from the internal compartment of the housing and separated from the power tool. A preferred embodiment of the power tool includes the use of a rechargeable, removable, portable power source and an electrical connector which allows the power tool to be powered by an alternate power source located externally of the power tool.

51 Claims, 19 Drawing Sheets

U.S. PATENT DOCUMENTS

| | | | | | |
|---|---|---|---|---|---|
| 4,899,414 | A | | 2/1990 | Irwin | |
| 4,954,026 | A | | 9/1990 | Zurwelle | |
| 4,965,905 | A | | 10/1990 | Kitahata et al. | |
| D312,714 | S | | 12/1990 | Simonelli et al. | |
| D313,094 | S | | 12/1990 | Itaya et al. | |
| 4,976,173 | A | | 12/1990 | Yang | |
| D317,667 | S | | 6/1991 | Bolser et al. | |
| 5,027,910 | A | * | 7/1991 | Honsa et al. | 173/162.2 |
| 5,038,523 | A | * | 8/1991 | Farber et al. | 451/344 |
| 5,074,081 | A | * | 12/1991 | Beth et al. | 451/344 |
| 5,086,105 | A | | 2/1992 | Abe et al. | |
| D332,734 | S | | 1/1993 | Fushiya et al. | |
| D338,754 | S | | 8/1993 | Skrzypek et al. | |
| 5,298,821 | A | * | 3/1994 | Michel | 310/47 |
| D349,789 | S | | 8/1994 | Bunyea | |
| 5,349,785 | A | * | 9/1994 | Nickels et al. | 451/357 |
| 5,368,424 | A | * | 11/1994 | Bettenhausen | 409/182 |
| 5,375,289 | A | | 12/1994 | Miyaoka | |
| 5,419,737 | A | | 5/1995 | Brazell et al. | |
| 5,564,969 | A | | 10/1996 | Tsang | |
| 5,593,312 | A | | 1/1997 | McCracken | |
| 5,595,531 | A | | 1/1997 | Niemela et al. | |
| 5,595,532 | A | | 1/1997 | McCracken | |
| D378,002 | S | | 2/1997 | Hung | |
| 5,642,008 | A | | 6/1997 | McCracken | |
| 5,678,272 | A | | 10/1997 | McCracken et al. | |
| D391,698 | S | | 3/1998 | McCracken et al. | |
| D392,778 | S | | 3/1998 | McCracken | |
| 5,794,300 | A | * | 8/1998 | McCracken et al. | 15/97.1 |
| 5,813,805 | A | | 9/1998 | Kopras | |
| 5,830,047 | A | | 11/1998 | McCracken | |
| 5,902,080 | A | * | 5/1999 | Kopras | 409/182 |
| 5,954,458 | A | | 9/1999 | Lee | |
| D414,666 | S | | 10/1999 | Cortes | |
| D418,264 | S | | 12/1999 | Rees | |
| D418,642 | S | | 1/2000 | Rees | |
| 6,168,507 | B1 | | 1/2001 | McCracken | |
| D443,397 | S | | 6/2001 | Williams | |
| 6,286,611 | B1 | * | 9/2001 | Bone | 173/216 |
| 6,290,587 | B1 | | 9/2001 | McCracken et al. | |
| 6,308,378 | B1 | * | 10/2001 | Mooty et al. | 16/430 |
| D465,074 | S | | 10/2002 | McCracken et al. | |
| 6,495,932 | B1 | * | 12/2002 | Yoshimizu et al. | 307/150 |
| D474,087 | S | | 5/2003 | Boyer et al. | |
| 6,558,090 | B2 | * | 5/2003 | Lagaly et al. | 409/182 |
| D475,908 | S | | 6/2003 | Boyer | |
| 6,573,621 | B2 | * | 6/2003 | Neumann | 307/150 |
| 6,601,272 | B2 | | 8/2003 | Stvartak et al. | |
| 6,629,331 | B2 | | 10/2003 | Panfili et al. | |
| 6,656,626 | B1 | | 12/2003 | Mooty et al. | |
| 6,725,491 | B2 | | 4/2004 | Hung | |
| 6,754,935 | B2 | | 6/2004 | Pozgay et al. | |
| 2001/0004580 | A1 | | 6/2001 | Legner et al. | |
| 2003/0182749 | A1 | | 10/2003 | Boyer et al. | |
| 2003/0199239 | A1 | * | 10/2003 | Hung | 451/357 |
| 2003/0228833 | A1 | | 12/2003 | Boyer | |

FOREIGN PATENT DOCUMENTS

| | | | | | |
|---|---|---|---|---|---|
| DE | 199 57 369 | A1 | | 6/2001 | |
| DE | 101 24 537 | A1 | | 2/2002 | |
| EP | 0 899 064 | A2 | | 3/1999 | |
| EP | 0 899 064 | A3 | | 6/2000 | |
| EP | 1 074 351 | A1 | | 2/2001 | |
| EP | 1074351 | A1 | * | 2/2001 | B25F 5/02 |
| EP | 1 302 284 | A1 | | 4/2003 | |
| EP | 1 400 318 | A3 | | 7/2004 | |
| JP | 02269555 | A | * | 11/1990 | B24B 23/00 |

OTHER PUBLICATIONS

Materials from wenproducts.com Internet website, 5pp. (no date of publication).

Partial European Search Report related to European patent application EP 03 00 6176, 7 pages (Feb. 9, 2004).

European Search Report related to European patent application EP 03 00 6176, 8 pages (May 24, 2004).

* cited by examiner

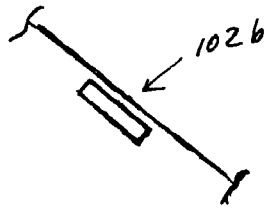
FIG. 17B
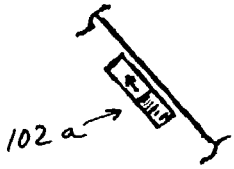
FIG. 17A
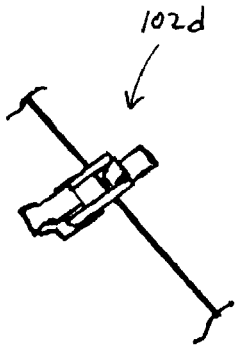
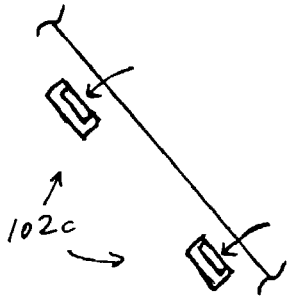
FIG. 17C
FIG. 17D

POWER TOOL WITH PORTABLE POWER SOURCE

FIELD OF THE INVENTION

This invention relates generally to a power tool having a removable, portable power source and, more particularly to a hand held polisher having a removable, portable power source in association with its housing.

BACKGROUND OF THE INVENTION

The tool industry offers a variety of cordless power tools for performing work on various types of workpieces. Each of these tools offer the advantage of being operated without a cord and/or remote from a generator or a hard wired power source, such as a conventional outlet. For example, cordless power tools allow the tool operator to use the tool without regard for both the proximity to a power outlet or to the length of available power. Battery-powered tools also allow the tool operator to operate the tool without interference and distracting concerns associated with an attached power cord.

Known power tools commonly locate the battery at the handle of the tool. This often tends to make the tool unbalanced and cumbersome to operate due to the unbalanced and oversized weight distribution. For example, a 14.4-volt or 18-volt battery located at the end of a power tool handle increases the weight distribution such that the tool becomes difficult to hold and operate steady for appropriate periods of time due to operator fatigue. This is of particular concern when working with generally vertical workpieces, such as a car door, as opposed to generally horizontal workpieces, such as a board laying flat on a workbench.

Experience also has revealed that an unbalanced tool renders it difficult to work evenly on a workpiece. For example, in the case of polishers, it is important to apply wax evenly over the workpiece and to polish and buff the workpiece evenly thereafter. If the power tool is unbalanced, the task of working the tool evenly about the workpiece becomes more difficult for the operator and has the tendency to make the tool work heavier on the side nearest the battery (the heavier portion of the tool).

Another shortcoming associated with handle located batteries is the tendency to require the handle to be larger than necessary. This compounds the difficulty and discomfort in holding the tool. For example, the size of a conventional battery pack often increases the handle size by at least 30 percent. The enlarged handle configuration tends to render the power tool more difficult and uncomfortable to handle.

An even further shortcoming with handle-mounted batteries is the limitation on the ability to provide a variety of gripping locations. For example, the addition of a battery pack to the handle often shortens the length of the portion of the handle on which one can grip. This results in reducing the number of different gripping positions on the handle.

Since a wide variety of individuals will be using the power tool, the shortcomings from having the battery pack in the handle make it difficult to meet the variety of demands each operator may have for the power tool.

Thus, there is a need for a power tool having a portable power source to enable the tool to be used in a variety of locations for a variety of different applications and in a convenient, efficient and effective manner.

SUMMARY OF THE INVENTION

A power tool in accordance with the invention includes a housing having an internal compartment with a motor therein, a handle connected to the housing for maneuvering the power tool, a working element connected to and driven by the motor to work on a workpiece, and a removable portable power source having a first position wherein the power source is located primarily in the internal compartment of the housing and being electrically connected to the motor to provide power to the motor for driving the working element and a second position wherein the power source is located remotely from the housing and detached electrically from the motor. A preferred embodiment of the tool also includes a battery release mechanism or lock associated with the housing and the removable portable power source. The lock has a lock position that prevents the removable portable power source from unintentionally becoming separated from the power tool, and an unlock position that enables the removable portable power source to be removed from the internal compartment of the housing and separated from the power tool. The lock may be connected to the housing and configured such that it remains connected to the housing when the removable portable power source is removed from the internal compartment, or may be connected to the removable portable power source and configured such that it remains connected to the removable portable power source when the removable portable power source is removed from the internal compartment of the housing.

The housing may also include a detachable portion that detaches at least in part from the housing to enable the removable portable power source to be selectively removed from the internal compartment of the housing. In a preferred embodiment, the detachable portion of the housing is attached to the removable portable power source and detaches entirely from the housing when the removable portable power source is removed from the internal compartment of the housing.

Ideally, the power tool will use a rechargeable removable portable power source so that the removable portable power source may be reused with the power tool. As such, the power tool may be configured with an electrical connector which is electrically connected to the motor for enabling the motor to be powered by an alternate power source located externally of the power tool when the removable portable power source is dissipated, or when the operator so desires to operate the power tool from an alternate power source. For example, the power tool may be connected via a power cord to an alternate power source located externally of the power tool. The alternate power source may be rechargeable and/or may require the use of a converter to convert the power output of the alternate power source from a first type of power to a second type of power for powering the motor.

The power tool may also include an outer elastomer surface, such as an elastomer injected overmolding, to facilitate enhanced gripping for control over the power tool. The handle may also be generally U-shaped to allow an operator a range of locations about the housing to facilitate an effective two-handed grip to maintain control over the power tool. In one embodiment, the handle may be designed with first and second end portions that are enlarged with respect to the remainder of the handle in order to provide the operator with a variety of grip sizes to choose from.

The power tool may also include an actuator electrically connected to the motor for activating and deactivating the power tool. The actuator may be positioned in a bridging member which connects the handle and the housing of the power tool, or may be recessed in the bridging member connecting the handle and the housing of the power tool in order to prevent accidental actuating thereof.

BRIEF DESCRIPTION OF THE DRAWINGS

FIGS. 17A–D are perspective views of alternate power source release mechanisms embodying feature of the present invention;

DETAILED DESCRIPTION OF THE PREFERRED EMBODIMENTS

Figure 6:
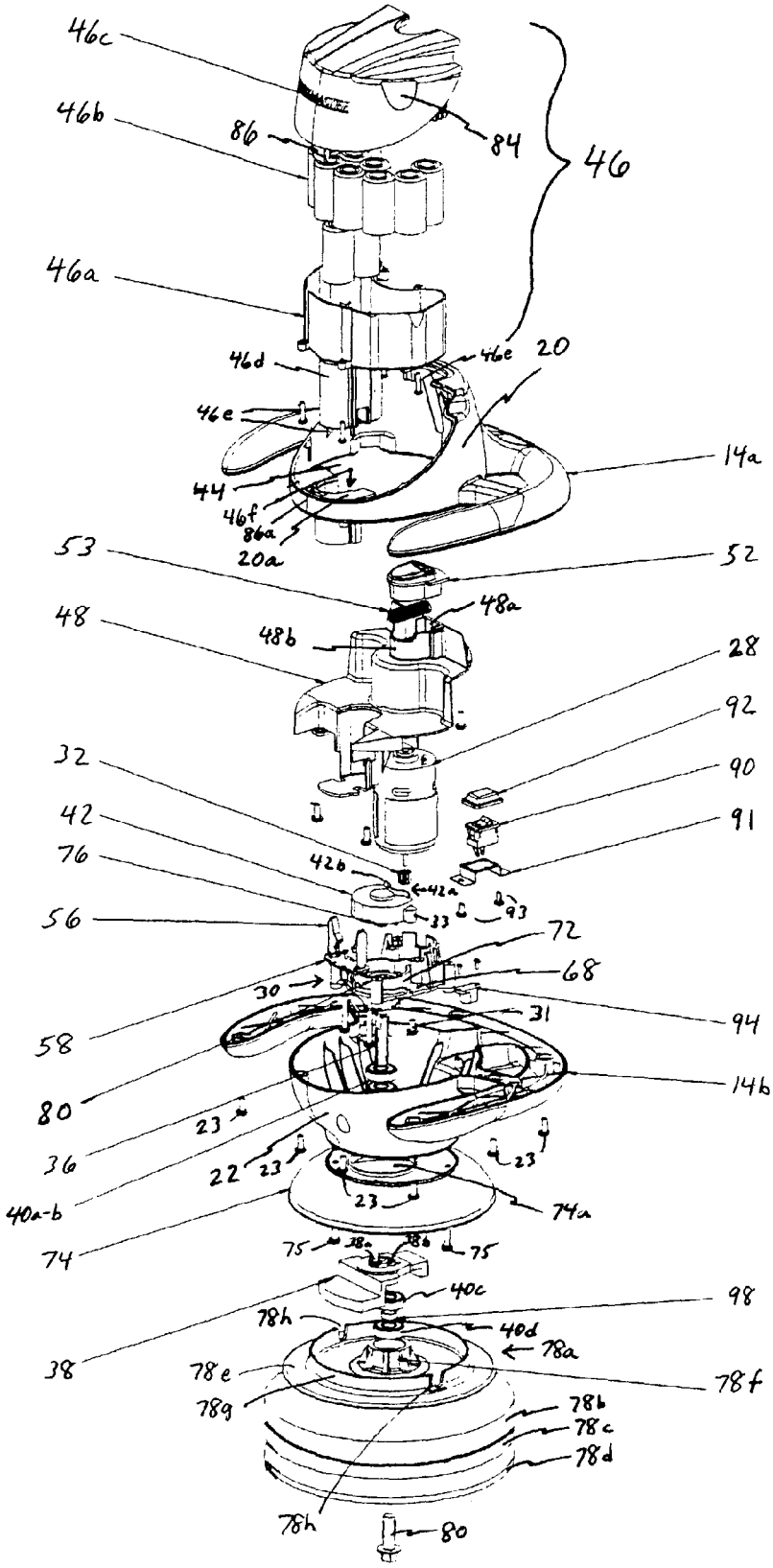
FIG. 6 is an exploded view of the power tool of FIG. 1.
Figure 7:
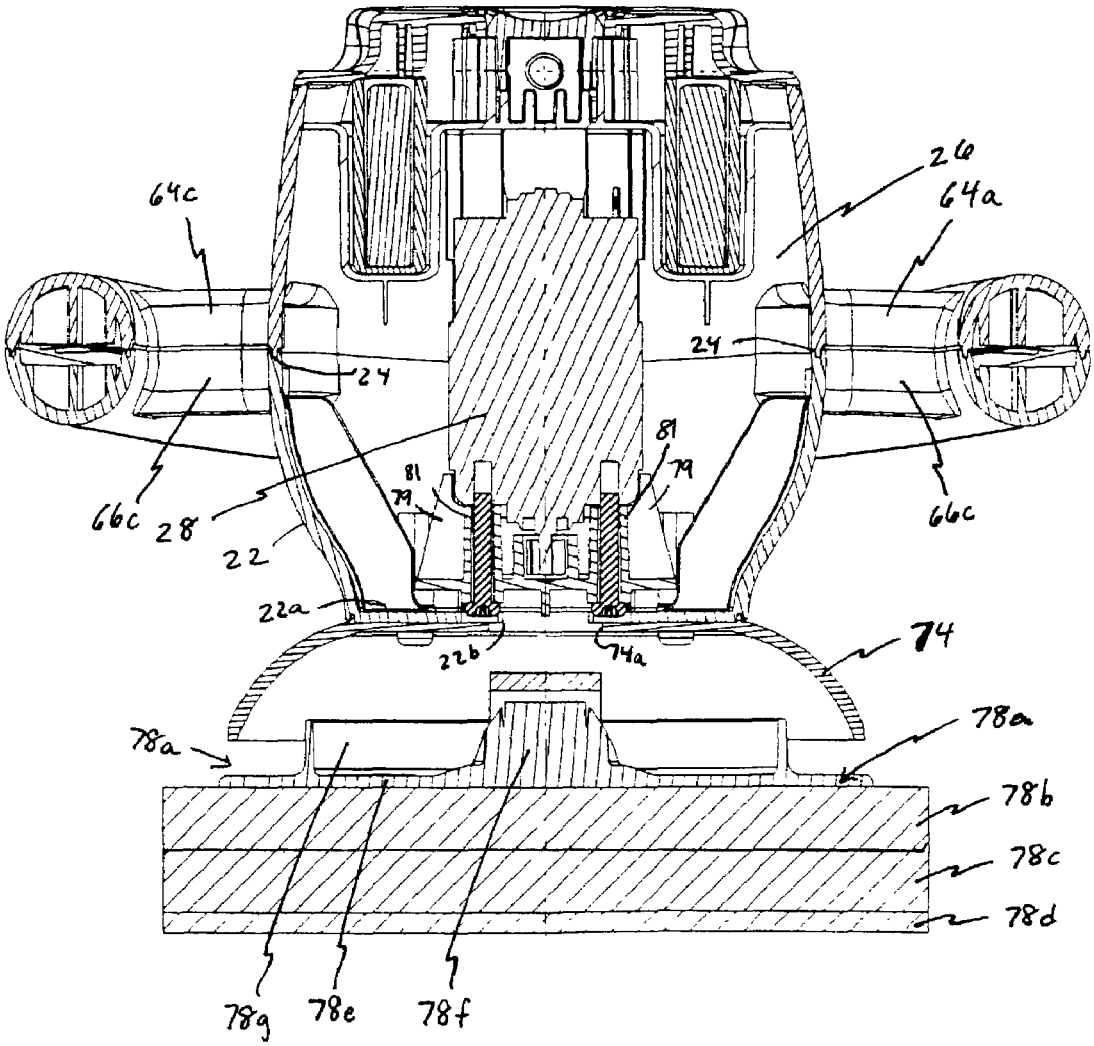
FIG. 7 is a cross sectional view of the power tool of FIG. 1 taken along line 7—7 in FIG. 3.
Figure 8:
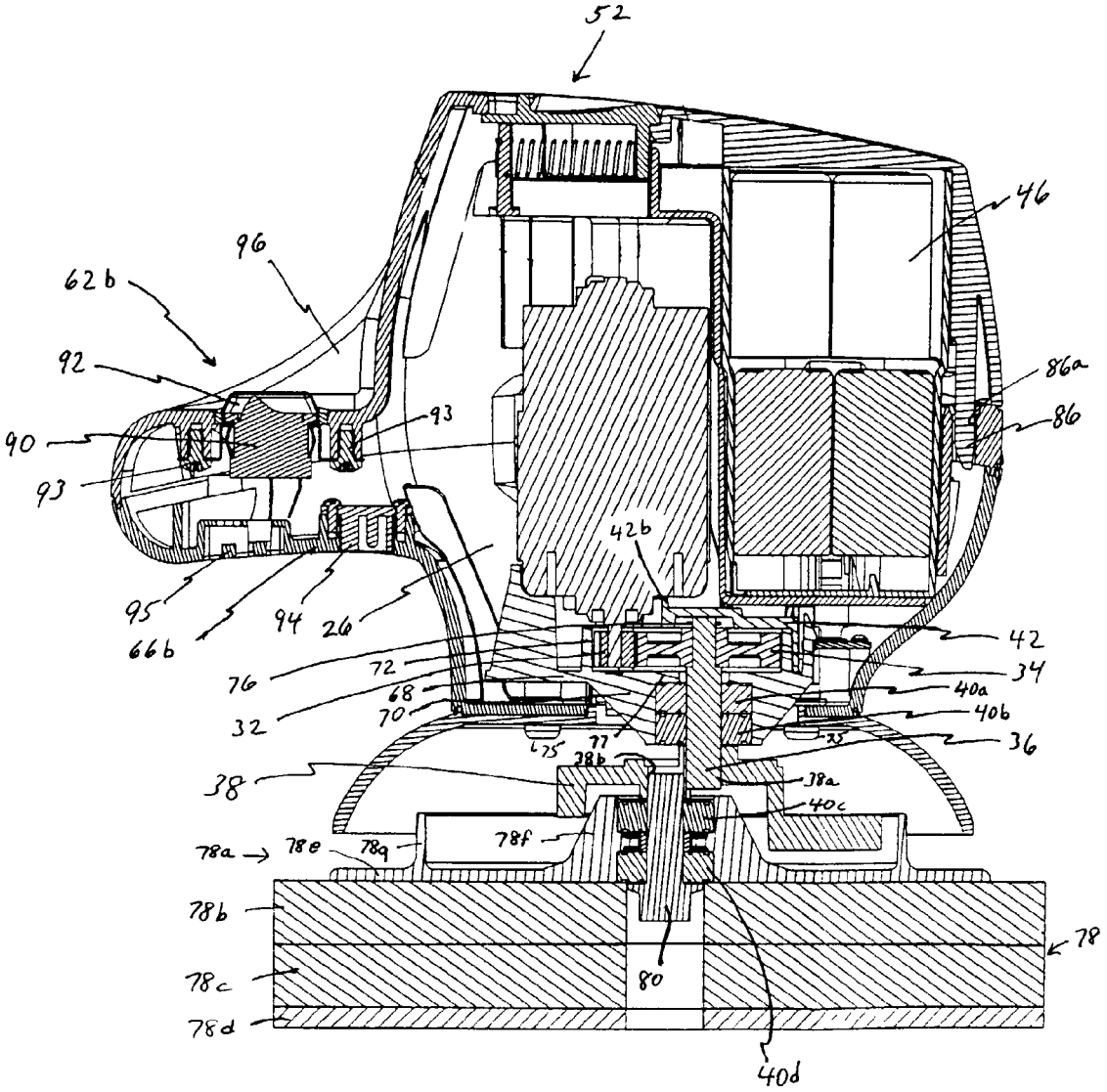
FIG. 8 is a cross sectional view of the operated power tool of FIG. 1 taken along line 8—8 in FIG. 2.

In FIGS. 1–10, there is illustrated a power tool 10 with a portable power source for working on a workpiece (e.g., waxing, buffing, polishing, etc.) in accordance with the present invention. The power tool 10 includes a housing 12, a generally U-shaped handle 14 connected to the housing 12, and a work element, such as a pad 16, for working on a desired workpiece, such as the body of a automobile or hull of a boat. The power tool 10 includes a symmetrical design about a vertical reference plane (not shown) extending centrally from a forward end 18*a* to a rearward end 18*b* (see FIGS. 3 and 4). The cross section illustrated in FIG. 8 is taken along the vertical reference plane.

The housing 12 includes an upper housing shell 20 and a lower housing shell 22 which, when connected to each other, interface along a part line 24. The upper housing shell 20 and lower housing shell 22 can be made of any suitably light-weight material and are preferably molded plastic parts. The upper housing shell 20 and the lower housing shell 22 are secured together by a number of screws recessed in the lower surface of the handle 14. Collectively the upper and lower housing shells 20 and 22 define an internal cavity 26. A motor 28 is disposed in the cavity 26 and is connected to a motor or gear mounting plate 30 also located within cavity 26. The mounting plate 30 is preferably secured to the inside of the lower housing shell 22.

The motor 28 is mechanically connected to the pad 16 and is capable of driving the pad 16 in an orbital path below the housing 12. More particularly, a motor output shaft 28*a* drives a first gear or pinion gear 32, which, in turn, drives a second gear or driven gear 34. The gears 32 and 34 are at least partially covered by gear casing or cover 42 in order to protect the gears from contaminants, such as dust or other residual particles from materials, such as wax, which are used on the workpiece in conjunction with the tool 10. A gear shaft 36 has a first end connected to the driven gear 34 and a second end to a counterweight 38. Rotation of the gear shaft 36 results in rotation of the counterweight 38 about the shaft 36. Moreover, rotation of counterweight 38 causes a corresponding rotation about the z-axis of the work element such as pad 16, which is connected to the counterweight 38. Bearings 40*a–d* are used to reduce the friction of the rotating members and allow the motor to operate more efficiently.

The housing 12 further defines a power source compartment 44 for holding a removable power source such as battery or battery pack 46. For example, as illustrated in FIG. 6, the removable power source 46 includes a lower battery pack housing 46*a*, multiple battery cells 46*b*, and an upper battery pack cover 46*c*. The battery pack housing 46*a* is complimentary shaped to fit within the housing 12, and includes a lower protruding member 46*d* extending downward from and below the lower housing 46*a*. When assembled, the battery cells 46*b* are inserted into the lower housing 46*a*, which is attached to the cover 46*c* via fasteners, such as screws 46*e*. The battery pack lower housing 46*a* is generally U-shaped or V-shaped with the protruding member extending downward below the general apex region of the U or V-shaped portion. The battery-style power source 46 is preferably designed to hold ten 1.2-volt cells and two dummy cells to produce a 12-volt power source, or twelve 1.2-volt cells to produce a 14.4-volt power source. In each instance, two cells are stored side-by-side in the lower protruding member 46*d*. This configuration allows for two separate models of the tool 10 to be provided from the same platform, thereby reducing the costs associated with offering multiple models.

The contacts or terminals 55 for the power source 46 are located on the bottom and/or lower side surfaces of the protruding member 46*d*, and are positioned to engage corresponding electrical contacts, such as spring contacts 56. The contacts 56, for example, are mounted on a printed circuit board (PCB) 58, which is connected to the inside of the power source compartment. This configuration allows conventional battery pack-type terminal configurations to be used, thereby further reducing the cost associated with manufacturing the apparatus 10.

The inside surface of the battery compartment 44 is separated from the internal cavity by a plastic lining wall or liner 48, which is configured to closely correspond to the shape of the power source pack 46. The shape of the liner 48 aids to properly guide the power source in and out of the compartment 44. For example, with reference to the embodiment illustrated in FIG. 6, the battery pack 46 can only be inserted into the compartment 44 with one orientation, i.e., with the protruding member of the housing 46*a* extending downward and the U or V-shape of the battery pack housing 46*a* matching the corresponding curved shape of the liner 48. Such configuration eliminates operator confusion with respect to installing the battery pack 46 and inadvertent or accidental electrical issues due to handling and installation of the battery pack 46.

The upper housing shell 20 includes an inner surface 20*a* which extends inward to combine with at least a portion of liner 48 to define a generally oval shaped recess to receive the protrusion 46*d* of battery pack 46. The electrical contacts or terminals 56 are located near the bottom of the recess 46*f*, where the PCB 58 is connected to a lower tongue portion of the liner 48. The remote location of the terminals 56 renders it even more difficult to improperly install and connect the battery 46 to the tool 10.

The power source 46 and the upper housing shell 20 interface at a parting line 50 when the power source 46 is properly associated with the tool 10. The parting line 50 runs about the periphery of the opening to the power source compartment 44. In other words, the parting line 50 defines the outer periphery of the cover 46*c* when the power source 46 is installed. The power source 46 is released by operating the release mechanism or lock 52 located on the top of the housing 12 adjacent the parting line 50. By actuating the release mechanism 52, a lock member is removed from engagement with a lock engaging surface so that the power source 46 can be removed from housing 12.

Figure 9:
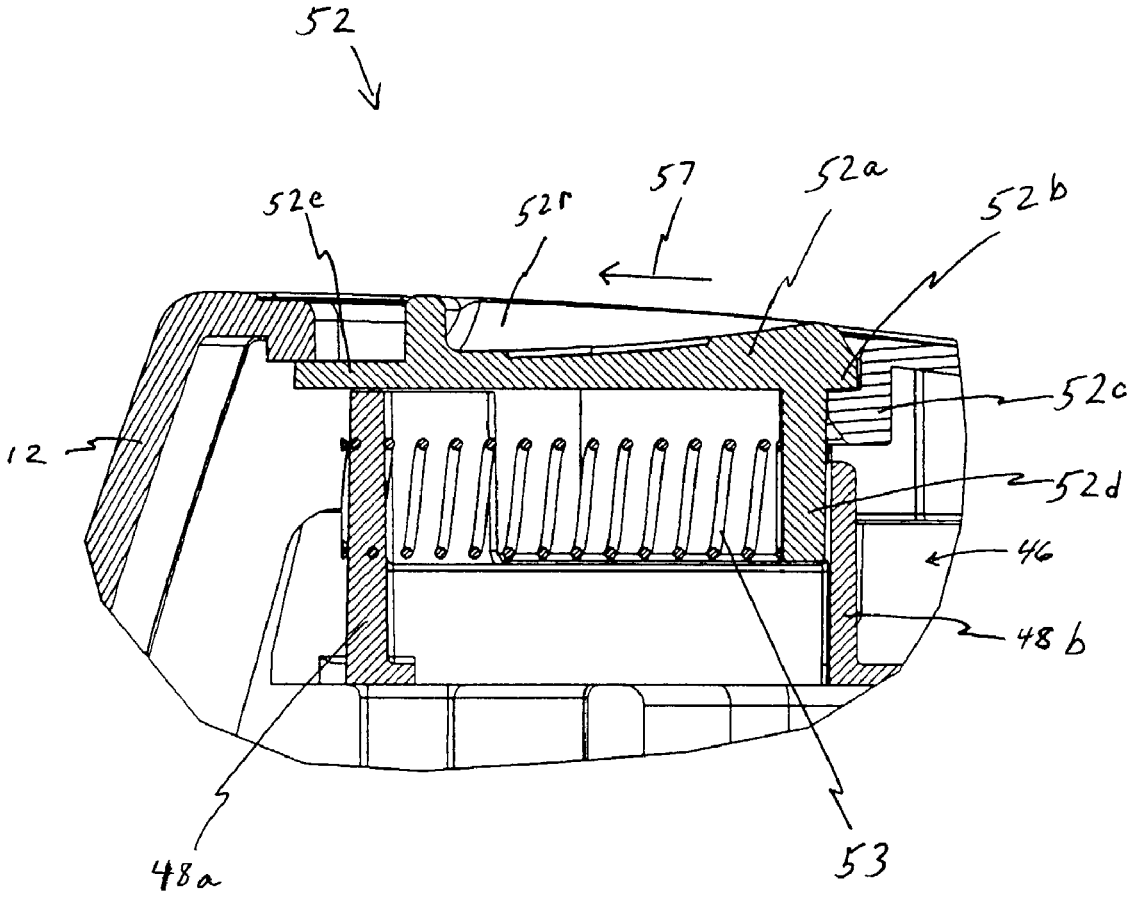
FIG. 9 is an enlarged view of a portion of FIG. 8 to illustrate a power source release mechanism.
Figure 10:
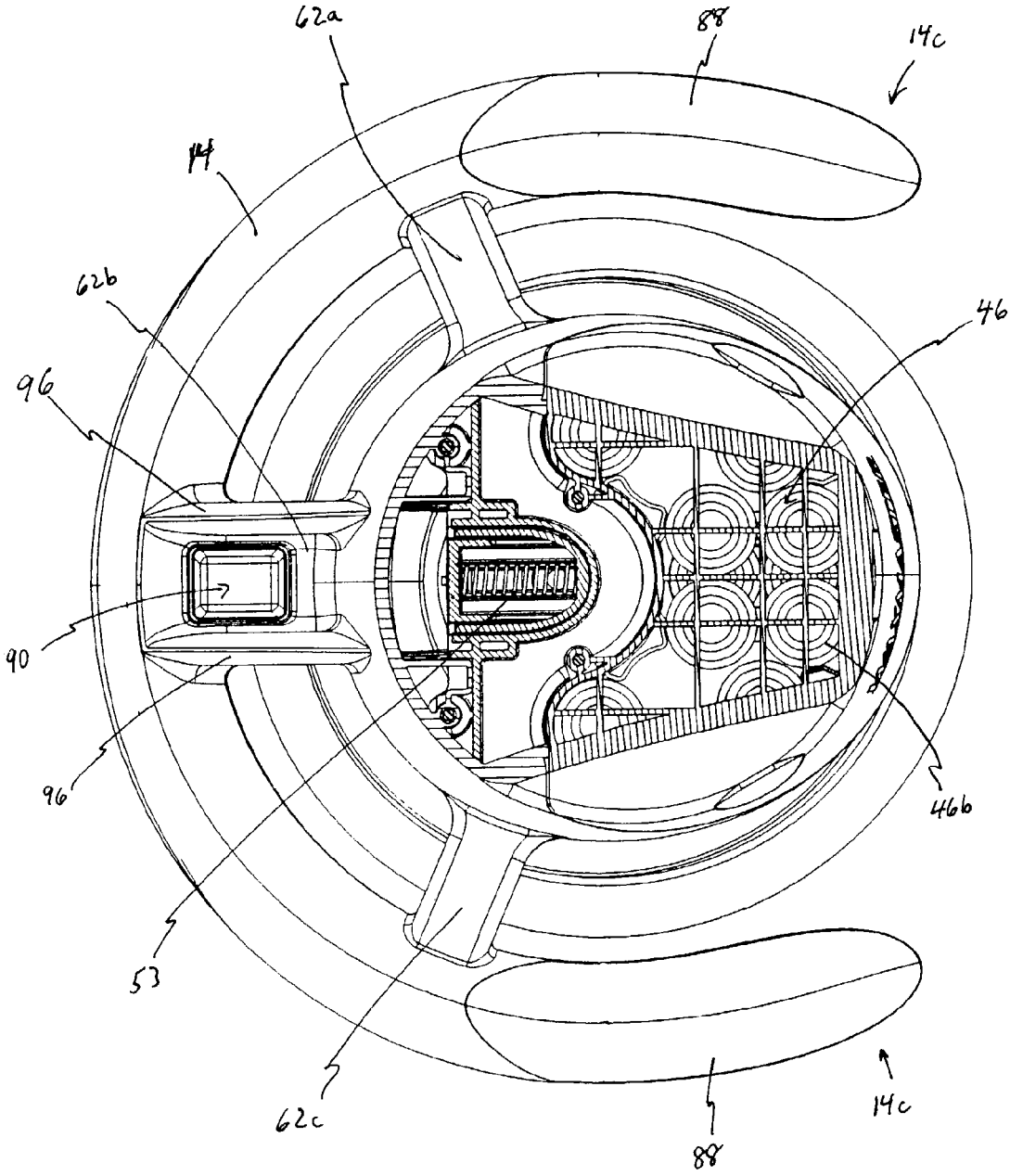
FIG. 10 is a cross-sectional view of the power tool of FIG. 1 taken along line 10—10 in FIG.2.
Figure 11:
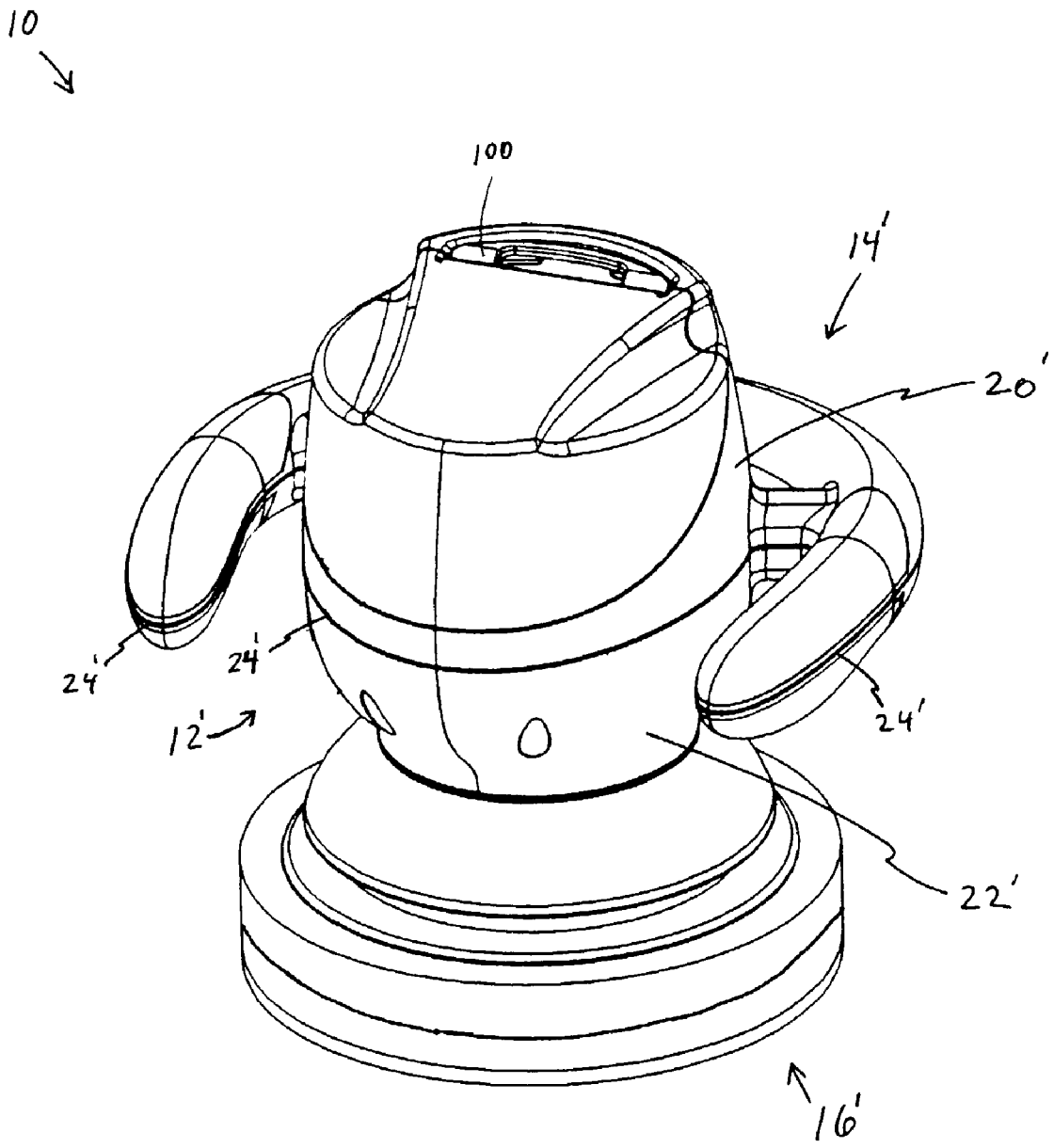
FIG. 11 is a perspective view of an alternate power tool embodying features of the present invention.
Figure 12:
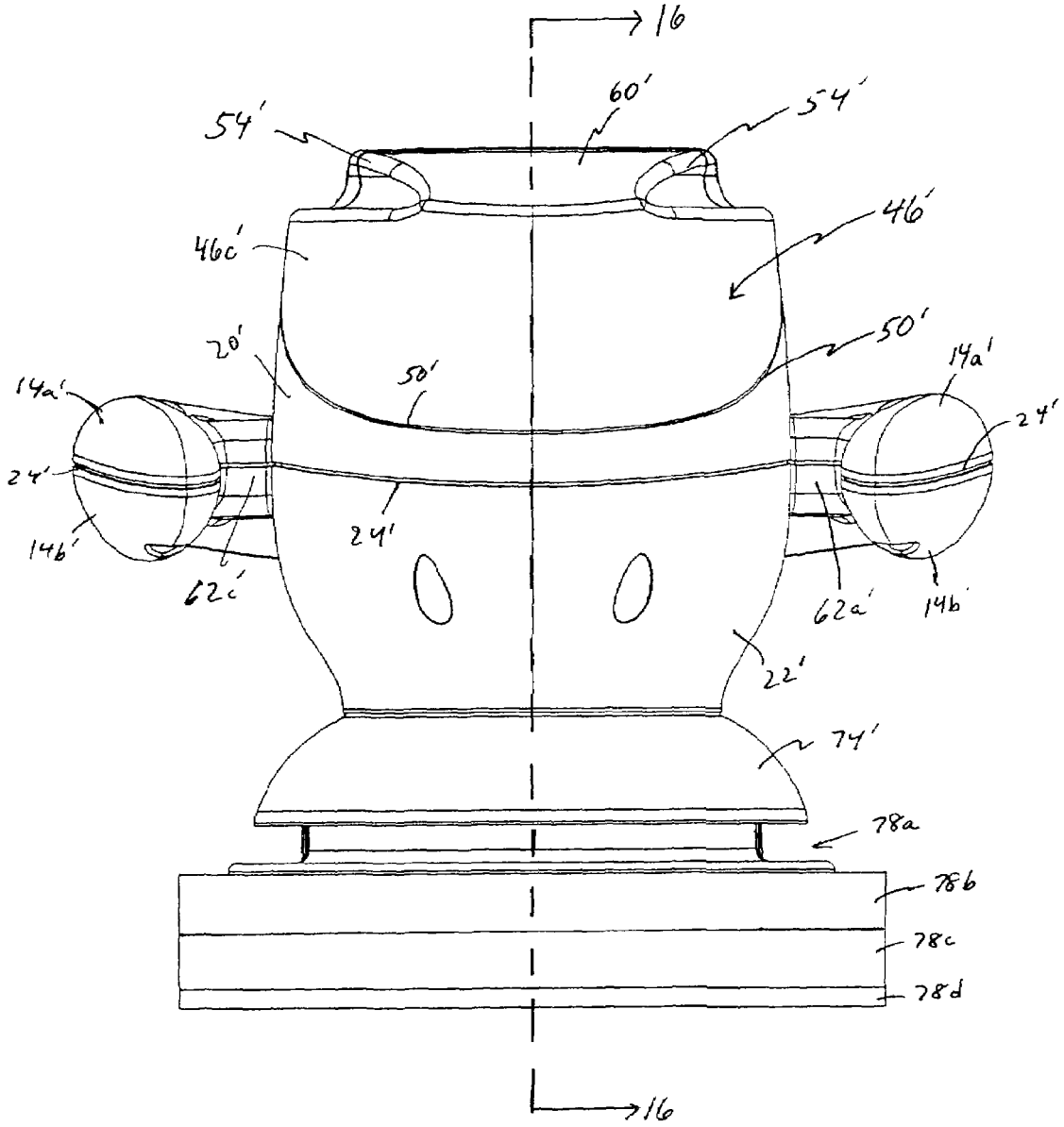
FIG. 12 is a front elevational view of the power tool of FIG. 11.
Figure 13:
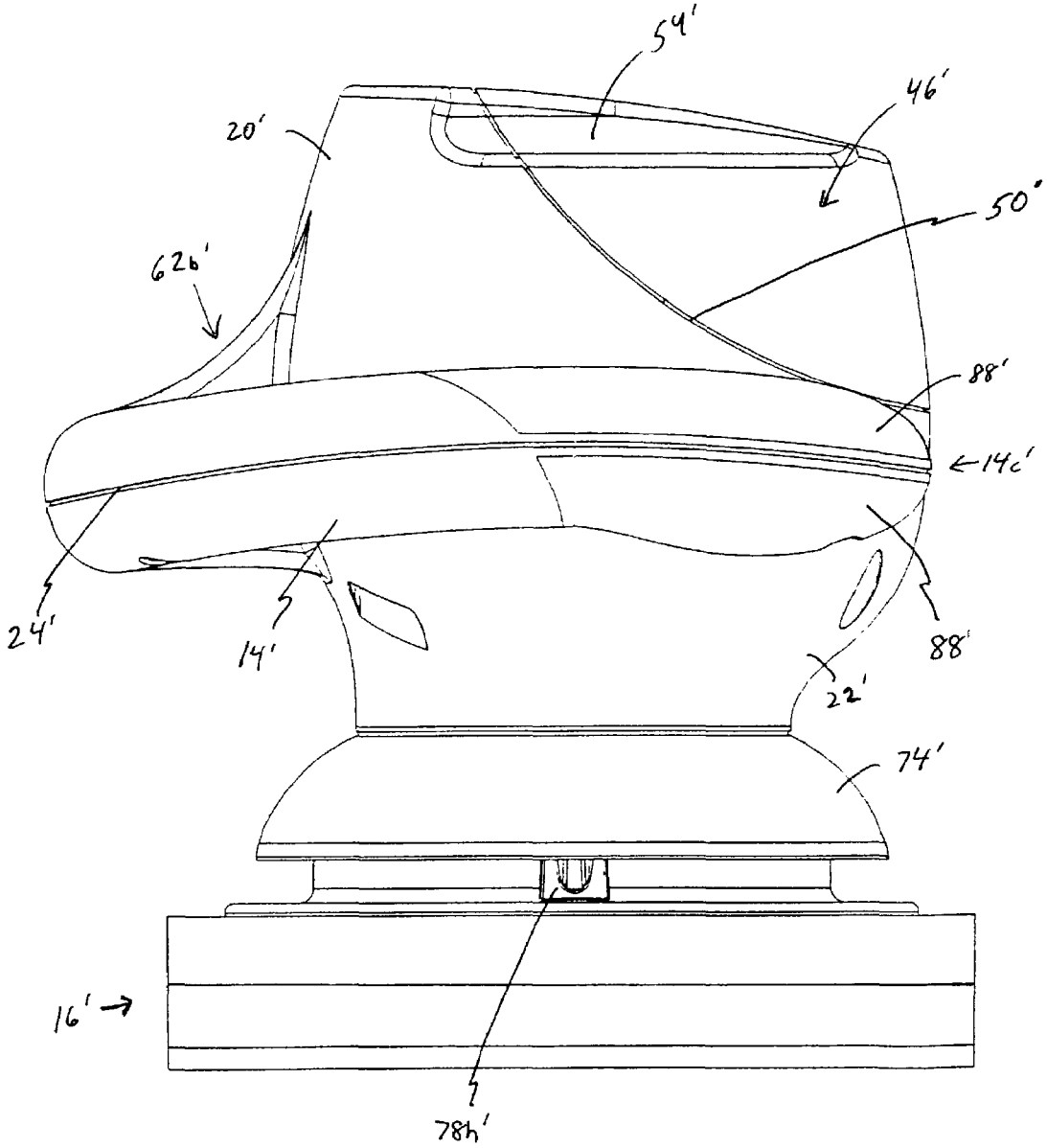
FIG. 13 is a right-side elevational view of the power tool of FIG. 11.
Figure 14:
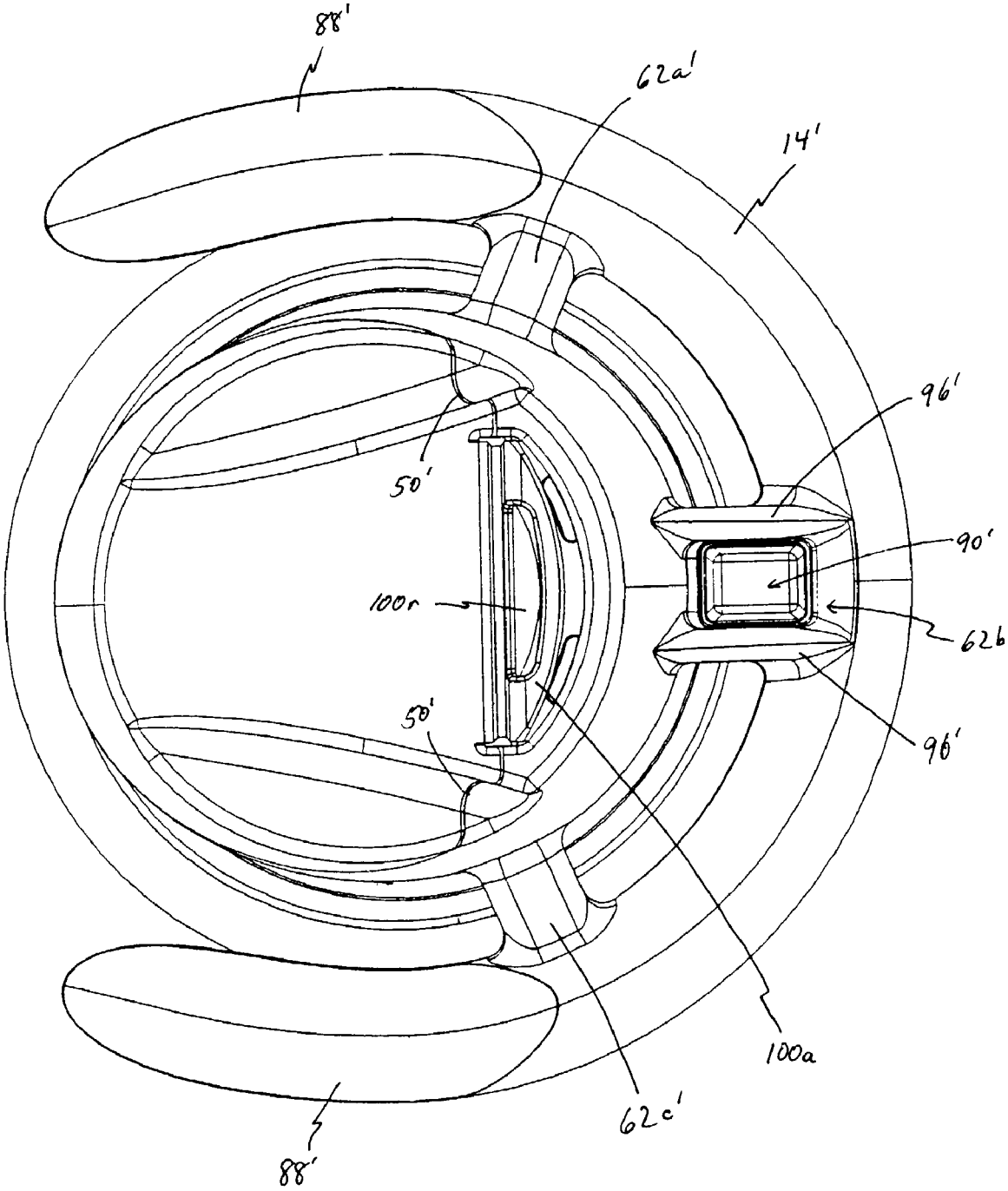
FIG. 14 is a plan view of the power tool of FIG. 11.
Figure 15:
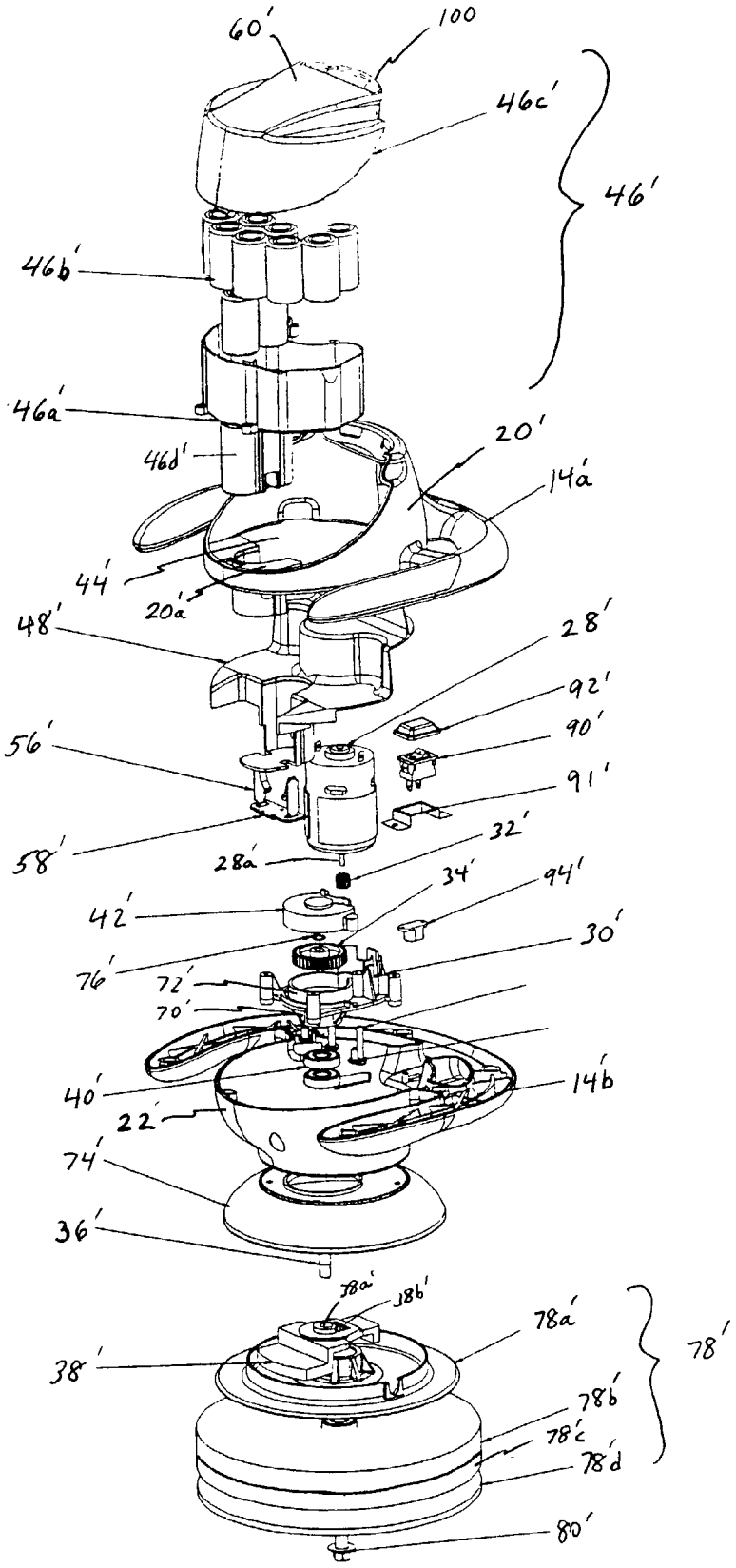
FIG. 15 is an exploded view of the power tool of FIG. 11.
Figure 16:
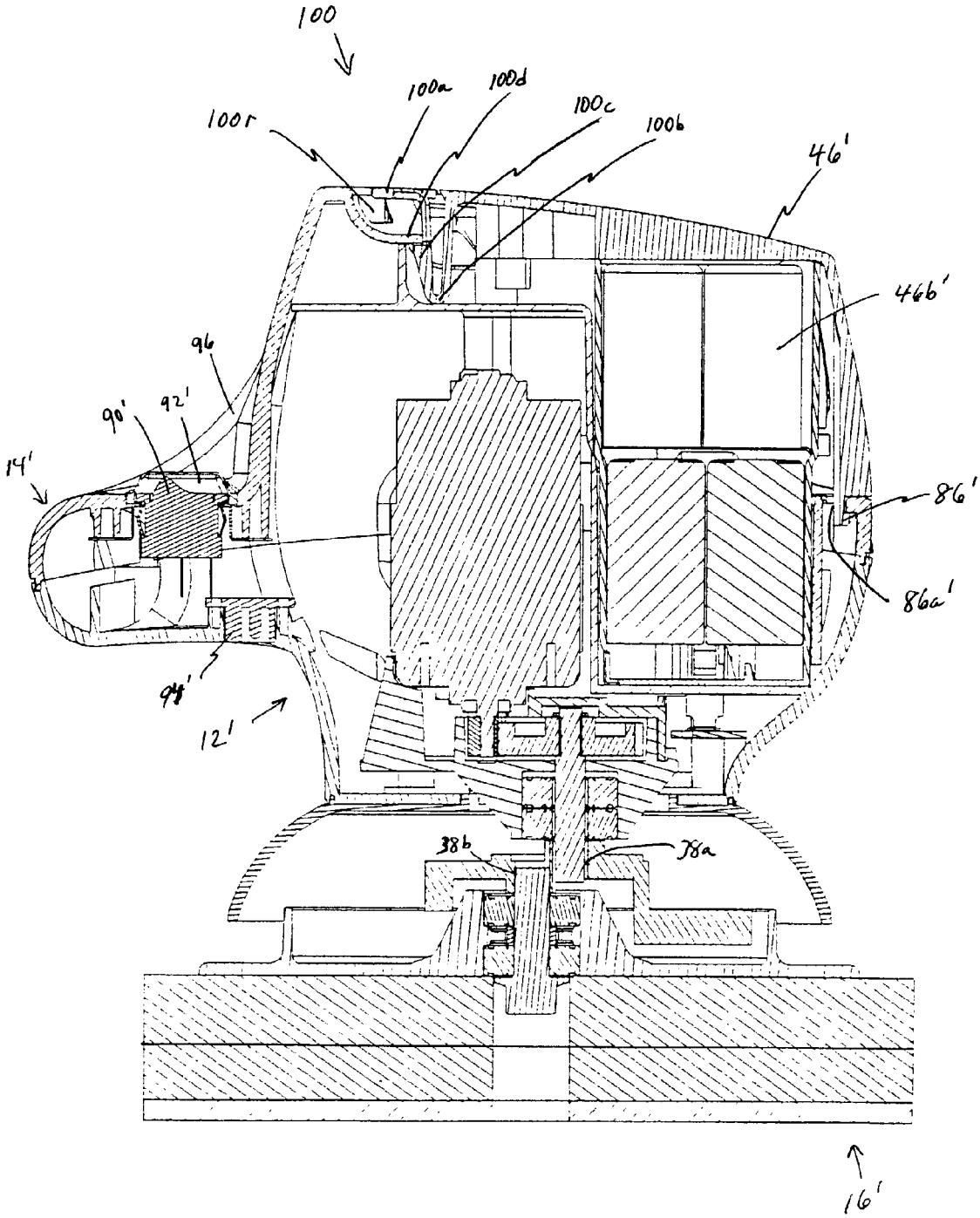
FIG. 16 is a cross-sectional view of the power tool of FIG. 11 taken along line 16—16 in FIG. 12.

As illustrated in FIGS. 6, 8 and 9, the power source 46 is removed by sliding a button portion 52*a* of the release mechanism 52 toward the rear 18*b* of the housing 12. This sliding,action causes a shoulder or hook portion 52*b* to disengage the lock engaging surface or lip 52*c* of power source 46. The shoulder portion 52*b* is normally biased to a lock position by a spring member 53 positioned between a vertical wall 48*a* of the liner 48 and a vertical wall 52*d* extending downward from the button portion 52*a* of the release mechanism 52. The length of travel of the button portion 52*a* in the locking direction is limited by an end stop 48*b* which also extends upward from the liner 48. This action maintains the spring 53 under a minimal amount of compression so that it remains in position between the vertical walls 48*a* and 52*d*, including when the power source 46 has been removed from the tool 10. Thus, when the release mechanism 52 is actuated the button portion 52*a*, shoulder 52*b* and vertical wall 52*d* are moved in the direction of the reference arrow 57. As a result, the spring 53 is compressed, and the shoulder 52*b* disengages the lip portion 52*c* so that the power source 46 can be removed from the tool 10. A guide member 52*e* extends out from the front of the button portion 52*a* and travels between the top end of the vertical wall 48*a* and another surface on the inside of the upper housing shell 20 to guide the movement made by the release mechanism 52 in a generally linear fashion.

Once the release mechanism 52 has been actuated, the operator may remove the power source 46 by grasping the shoulder or gripping grooves 54 (FIG. 2) of the power source 46, which are formed along the sides of the raised portion 60 of cover 46*c*. The gripping grooves 54 form an ergonomic handle which the operator may use to pull the power source 46 from the tool 10. In a preferred form, the spacing between the gripping grooves 54 tapers toward one another as they extend from the rear 18*b* of the housing 12 to the front 18*b* of the housing. This provides a grip of varying widths to accommodate operators with differing hand sizes. The raised portion 60 also tapers downward as it approaches the front of the housing 18*a* so as to become generally flush with the top edge of the housing 12 at the front of the tool 10. To assist in the removal of the power source 46, the button portion 52*a* defines an inclined recessed area 52*r* which facilitates an operator's ability to efficiently and effectively actuate the release mechanism 52*a*. Thus, the power source 46 can be removed with a single hand. For example, an operator may press or slide the release switch 52 with his or her index finger and grasp the gripping grooves 54 with the thumb and remaining fingers. Alternatively, the operator may remove the power source 46 by grasping or palming the outer surfaces of the power source with his or her hand and actuating the release mechanism 52 with either the index finger on the same hand or with a finger or thumb from the other hand. In addition, the power source 46 may further include indentation or grooves 84 which provide enhanced engagement surfaces for the operator to position his or her fingers on the battery cover 46*c* to facilitate effective removal and installation of the power source 46.

When the power source 46 is installed, the spring action of the release mechanism 52 allows the power source 46 to snap into its secure position in the housing 12. More specifically, the shoulder 52*b* and the lip portion 52*c* of the release mechanism 52 have cooperating cam surfaces so that when the shoulder 52*b* is moved a sufficient amount, the lip portion 52*c* passes below the shoulder when the power source 46 is installed into the housing 12. Once the lip 52*c* has cleared the shoulder 52*b*, the spring 53 biases the shoulder 52*b* into engagement with the lip 52*c* so that the power source 46 is secured in the housing 12. The power source 46 also has at least one tongue member or post 86 for inserting into a mating recess located on the housing 12 to help secure and align the battery pack 46 in the housing 12. As illustrated in FIGS. 6 and 8, a preferred form of tongue member 86 has a rectangular cross-section and a tapered tip for sliding in and out of a cooperating aperture 86*a* defined by the housing shell 20. The tapered tip enables effective insertion of the tongue member 86 into the recess 86*a*. Other tongue members or alignment tabs may be positioned about the power source 46 in order to help align and/or secure the power source 46 in the housing 12. For example in FIG. 6, additional tabs appear on the side of the power source 46 to assist the tongue 86. In alternate embodiments, the tongue and/or tabs may extend from the housing 12 and the recesses may be defined by the power source 46. In even other embodiments, a combination of tongue and/or tab members and recesses may appear on both the power source 46 and the housing 12.

As illustrated in FIGS. 1–10, the remainder of the upper housing portion 20 is contoured to coordinate with the cover 46*c* of power source 46. For example, the sidewalls of the upper housing shell 20, which define the battery compartment 44 opening and form part of mating line 50, are arcuately shaped to match the corresponding sidewalls of cover 46*c*. Furthermore, the rear sidewall of the upper housing shell 20 contains recesses or shoulder portions which correspond to the gripping portions 54 of the cover 46*c*.

The lower housing shell 22 is generally bowl-shaped with a planar bottom wall 22*a*. An arcuate shield or skirt 74 is attached to the bottom wall 22*a* by screws 75. As illustrated in FIG. 7, the upper and lower housing shells 20 and 22 are connected in a tongue and groove fashion along the parting line 24 and, when mated together, define the internal cavity 26 to house the motor and gearing. The lower wall 22*a* (FIG. 19) of the lower housing shell 22 and the shield member 74 each define an opening 22*b*, 74*a*, respectively, which are aligned and through which at least a portion of the gear/motor mount 30 passes.

As illustrated in FIGS. 6 and 8, the gear/motor mount 30 has a lower planar portion 68 with a frusto-conical portion 70 extending downward therefrom, and an annular wall portion 72 extending upward therefrom. The frusto-conical portion 70 defines a hollow inner region in which bearings 40*a* and 40*b* are disposed, and a passageway for the gear shaft 36. Due to an internal shoulder portion 77 in the frusto-conical portion 70, and the counterweight 38, the bearings 40*a–b* are retained in the hollow region and the shaft 36 is allowed to pass through the portion 70. The planar portion 68 of the mount 30 is attached to the lower housing shell 22 such that the frusto-conical shaped portion 70 and the gear shaft 36 extend through the opening 22*b* defined by the lower wall 22*a* of the lower housing shell 22 and the opening 74*a* defined by the shield member 74. The gear/motor mount 30 and shield member 74 are fastened to the lower wall of the lower housing shell 22 by fasteners, such as the screws 75.

The annular wall portion 72 of the gear/motor mount 30 defines a main cup portion to hold the driven gear 34 and defines a smaller secondary cup portion, adjacent the main cup portion, to hold the pinion gear 32 such that their teeth are intermeshed with one another. As an example, the tool 10 has a 4.56:1 gear ratio in order to step down the roughly 18,000 revolutions per minute (RPM) capable of being generated by motor 28 to approximately 2,400–4,000 RPM. This results in a significantly higher torque output than is currently available in the marketplace.

As mentioned above, the gear shaft 36 is connected to the driven gear 34. More particularly, the upper end of the gear shaft 36 is polygonal in shape and extends through a central opening in the driven gear 34, which is of a complementary polygonal shape so that rotation of gear 34 also rotates the shaft 36. For example, the upper end of the gear shaft 36 preferably has a generally rectangular cross-section, and the opening in the gear 34 is of a complementary sized, generally rectangular cross-section. Thus, rotation of the gear 34 results in a corresponding rotation of the gear shaft 36.

A stop 76, such as a ring, clip or pin, is fitted on the upper end of the gear shaft 36 extending beyond the gear 34 in order to prevent the gear shaft 36 from sliding out of engagement with the gear 34. For example, if a ring or clip is employed, such as a C-clip or E-clip, the gear shaft 36 has an annular groove about the end portion of the shaft that extends above the gear 34 so that the ring or clip 76 can be connected to the shaft 36.

Below the driven gear 34, the gear shaft 36 takes on a larger, circular cross-section creating a shoulder to support the gear 34 from below. This configuration limits the amount the shaft 36 can be inserted into the central opening of the gear 34, allows the shaft 36 to better fit the circular openings of the bearings 40*a–b*, and reduces friction caused by the rotation of the shaft 36. The lower end of the gear shaft 36 is threaded to enable a threaded engagement with the counterweight 38, as discussed in further detail below in connection with the work element 16.

The gear cover or casing 42 is connected to the gear/motor mount 30 and is positioned over a majority of the annular wall 72 like a sleeve in order to aid in sealing the gears 32 and 34 and associated grease from contaminants. More particularly, the casing 42 forms a generally cylindrical sleeve over the driven gear 34 and has a raised center portion to accommodate the portion of the gear shaft 36 which extends slightly above the driven gear 34 and the associated stop 76. The casing 42 also has a semicircular notch 42*a* formed in the side adjacent the smaller secondary cup portion of the annular wall 72 to provide clearance for the motor shaft 28*a* and pinion gear 32. The notch 42*a* has a sidewall 42*b* extending upward therefrom which further serves to support and space the motor 28 with respect to the casing 42 and the gear/motor mount 30. The casing 42 is secured to the gear/motor mount 30 via fasteners, such as screws 31, which are thread into threaded columns or bores 33 attached to the outer sidewalls of the casing 42.

A plurality of support gussets 79 and hollow posts 81 also extend from the planar portion 68 of gear/motor mount 30. The hollow posts 81 are internally threaded and are used to mount the gear/motor mount 30 to the housing 22 and secure the motor 28 on the support gussets 79. With this configuration, the internal mechanisms of the tool 10, such as the motor 28, the gears 32 and 34 and the gear shaft 36, are held in operating position and reduce the occurrence of undesirable vibration when the tool is operated.

Figure 1:
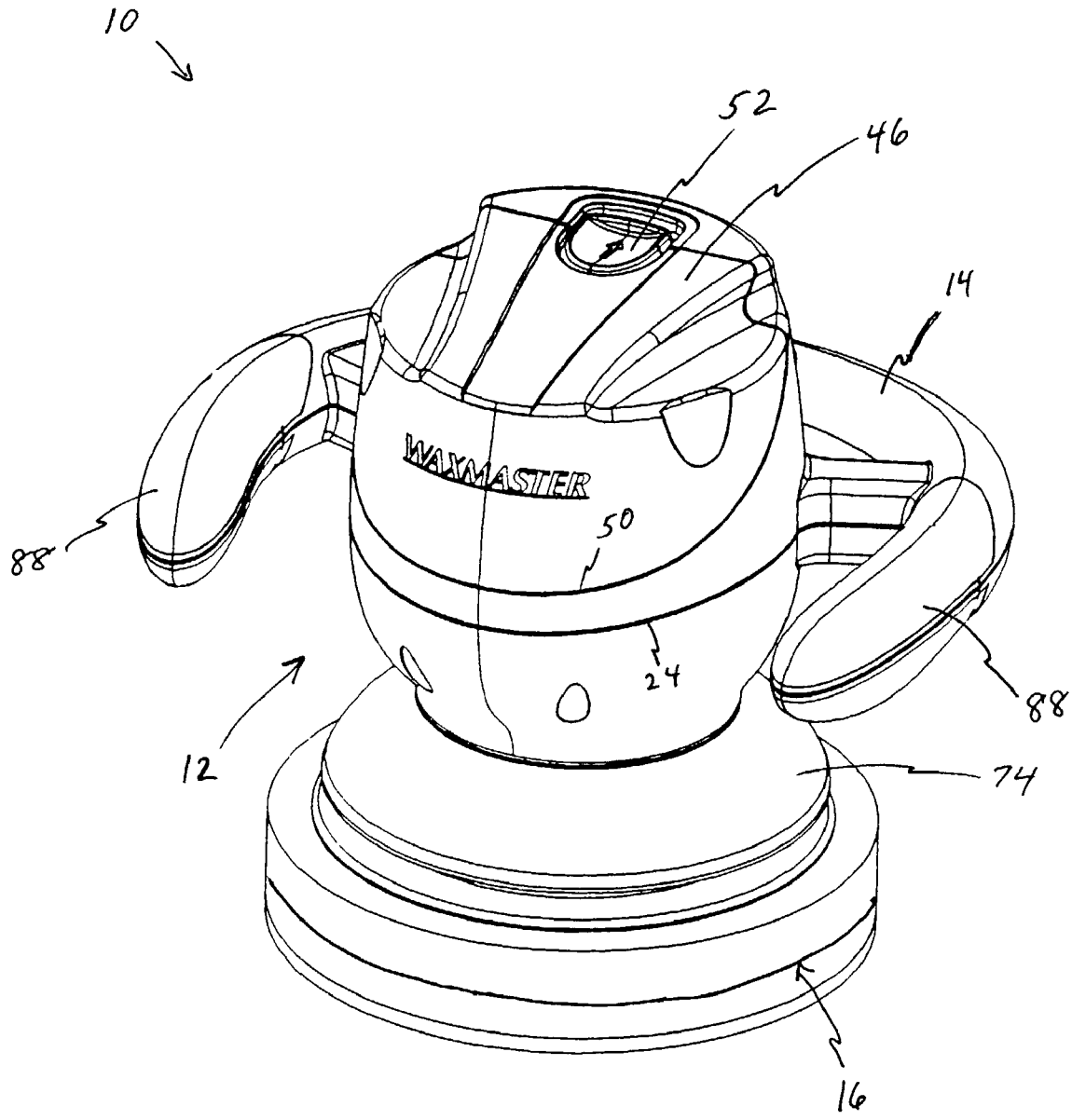
FIG. 1 is a perspective view of a power tool embodying the features of invention.
Figure 2:
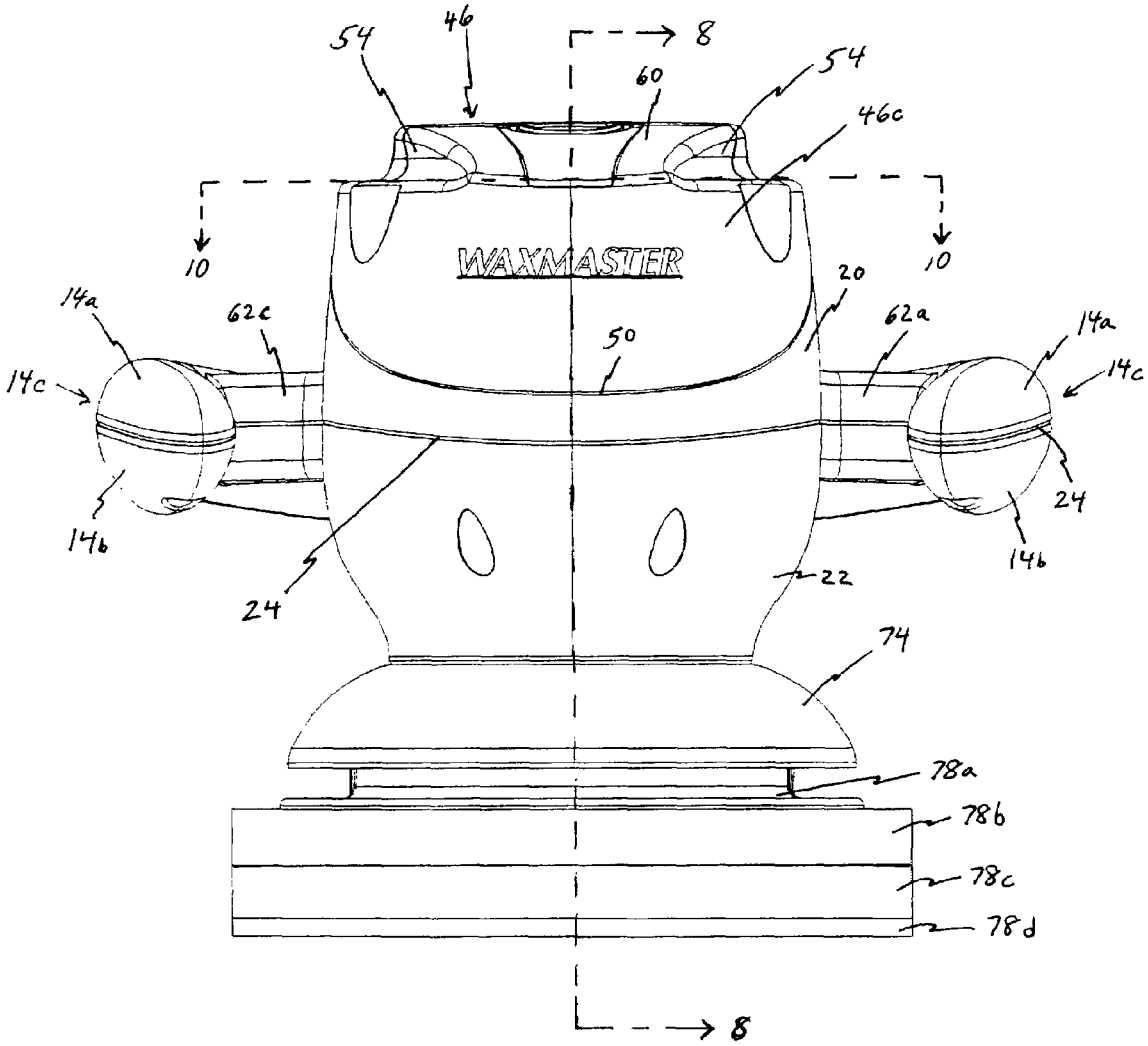
FIG. 2 is a front elevational view of the power tool of FIG. 1.
Figure 3:
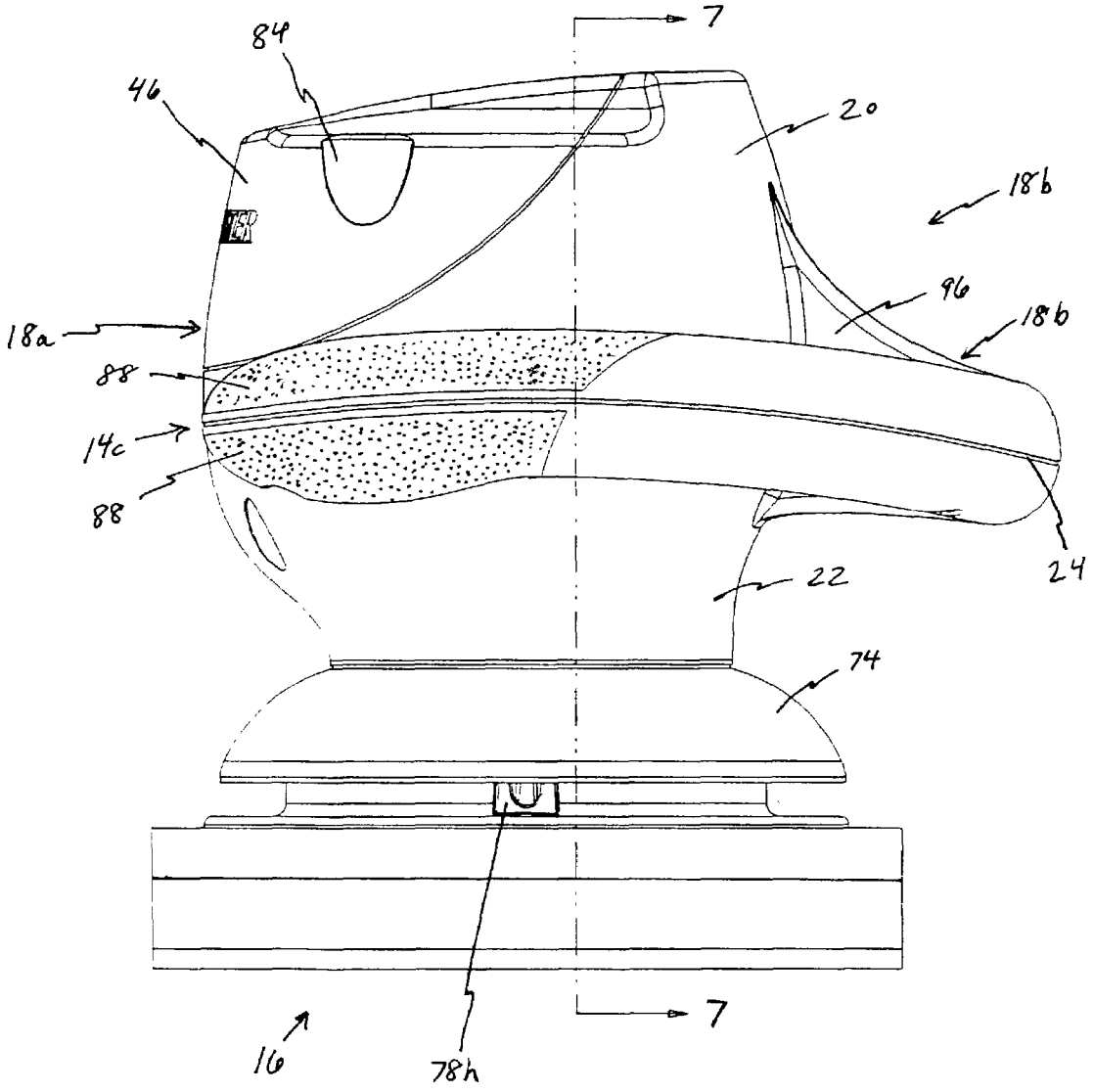
FIG. 3 is a left-side elevational view of the power tool of FIG. 1.
Figure 4:
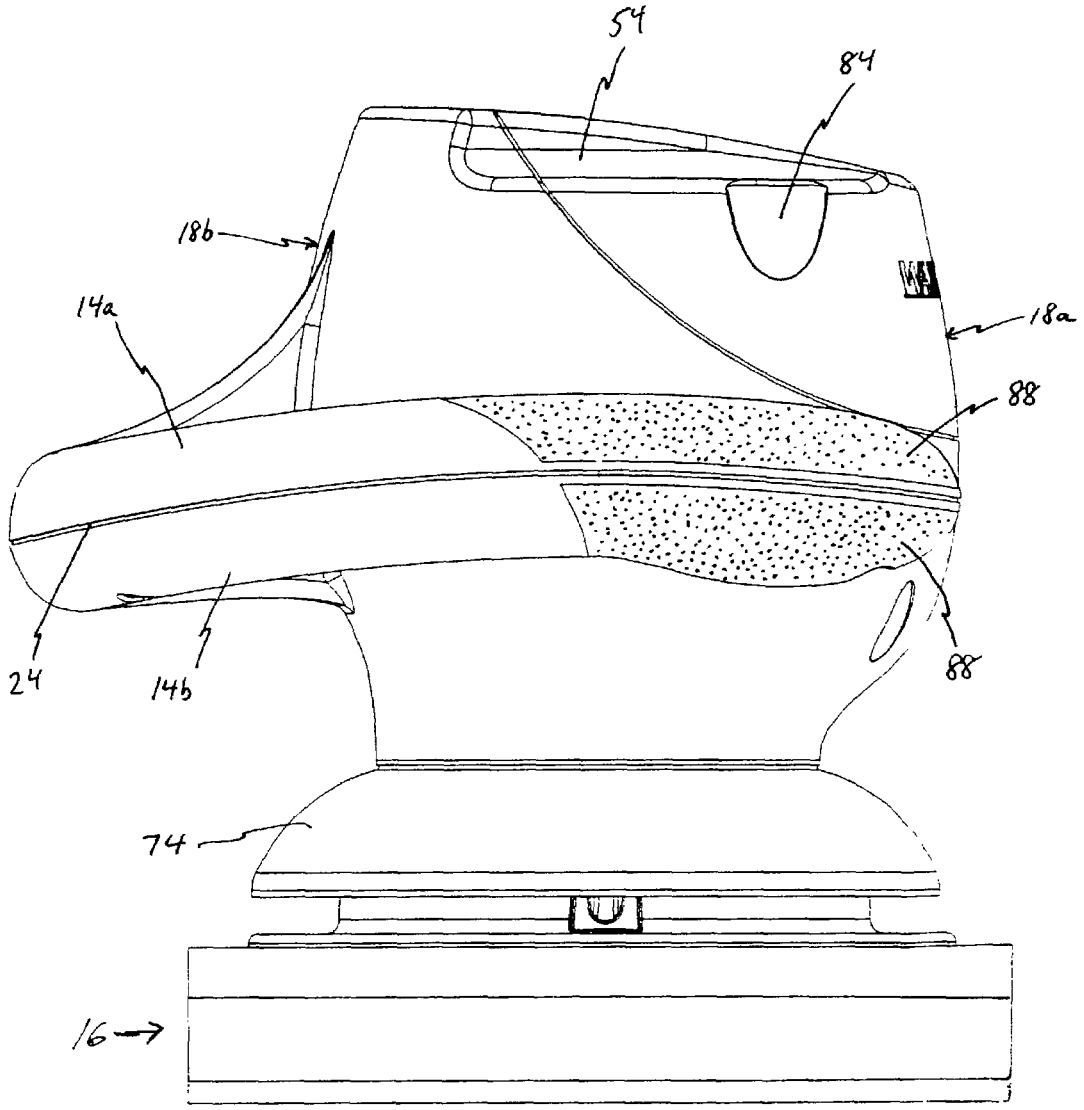
FIG. 4 is a right side elevational view of the power tool of FIG. 1.
Figure 5:
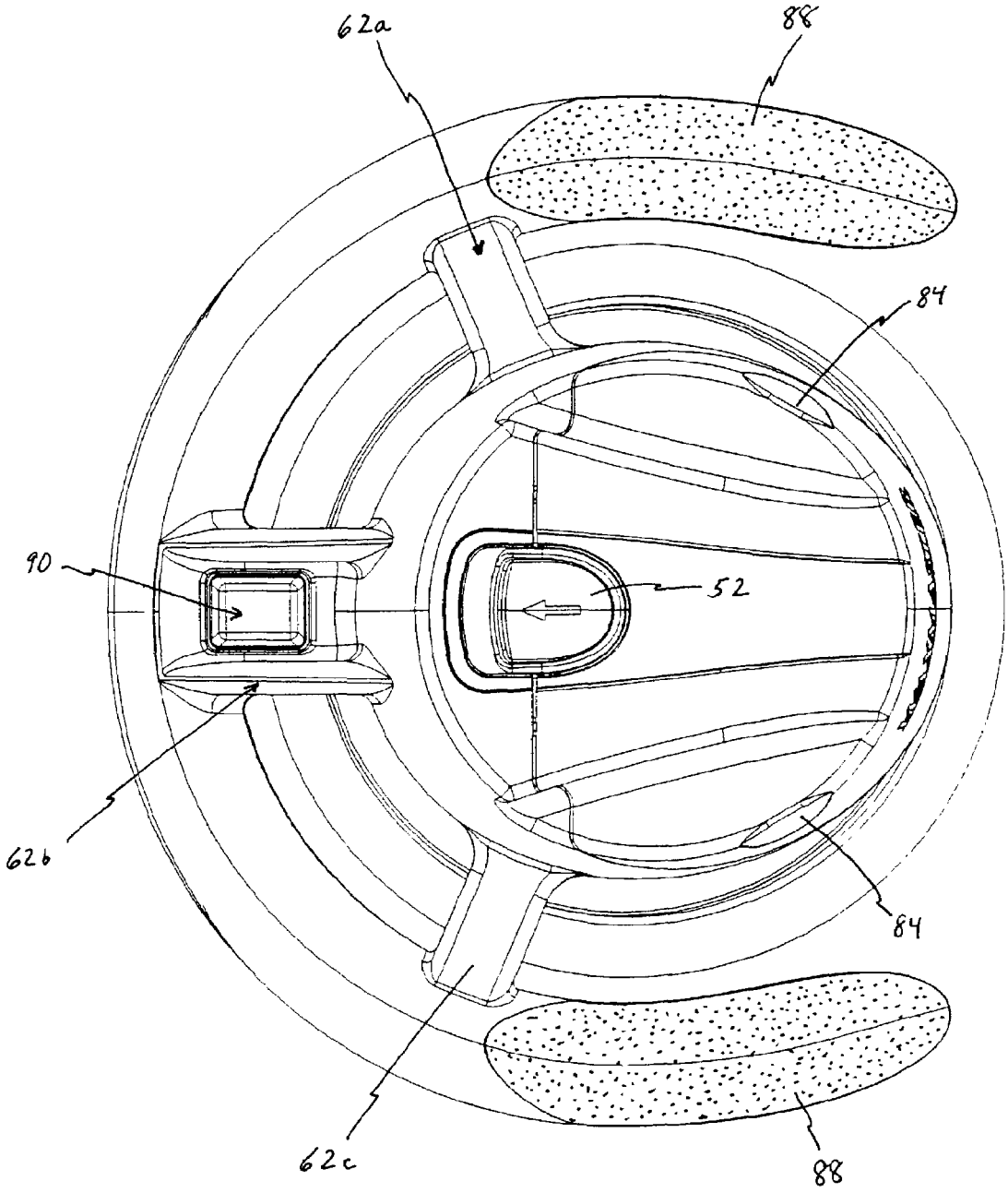
FIG. 5 is a plan view of the power tool of FIG. 1.

The handle 14 has a generally round cross-section and is generally U-shaped in order to provide the operator with a plurality of locations to facilitate an effective two-handed grip to maintain control over the tool 10. More particularly, upper and lower handle portions 14*a* and 14*b* connect along the part line 24 in a tongue and groove fashion and are secured together by screws 23 or other fasteners which are inserted into recessed bores located in the lower portion 14*b* of the handle 14. The handle 14 is preferably bowed, as best seen in FIG. 3, so that the ends 14*c* of the handle 14 dip slightly downward to form a more comfortable gripping region for the operator. In addition, the ends 14*c* of the handle 14 are enlarged with respect to the remainder of the handle 14 and have an outer elastomer surface or grip 88 to facilitate enhanced gripping for control over the tool 10. For example, as shown in FIG. 3, the lower surface of the handle end 14*c* is curved in a convex manner to provide an enlarged gripping surface or enlarged handle portion.

Both the enlarging of the handle ends 14*c* and the bowing of the handle 14 provide the operator with a multi-dimensional handle which offers greater control over the tool than traditional handles in the market place. For example, the enlarged ends 14*c* offer the operator greater control over the tool 10 by increasing the surface area of the handle thereby allowing the operator to use more of his or her hand to grip the tool and to maintain a stronger grip thereon. The enlarged ends 14*c* also allow the operator to maintain a forward grip on the end of the handle which may assist the operator in drawing the tool 10 back towards the operator. In addition, the enlarged ends 14*c* allow the operator to "feel" the ends of the handle without the need to visually locate them. This allows the operator to frequently focus on the workpiece while grasping the tool rather than requiring the operator to break visual contact with the workpiece to determine where the ends of the handle 14 are. The enlarged ends 14*c* also provide the operator with a physical and visual end stop about which the operator knows he or she can not move beyond. Furthermore, the enlarged ends 14*c* position the operators hands when grasped in locations which are generally centrally balanced with respect to the tool 10 and generally balanced about the tools center of gravity. Thus, this provides the operator with a more comfortable, secure and strong grip of the tool 10.

The elastomer grip 88 is provided on both the upper and lower portions 14*a* and 14*b* of the handle 14 and is preferably added via an injection overmolding process. More particularly, the handle 14 is preferably formed by a plastic injection molding process, which is later followed by injection of a grip layer material to form grip 88. A preferred material for the elastomer grip is an elastomer/plastic blend, such as, for example, SANTOPRENE, which is a product of Advanced Elastomer Systems, L.P. of Akron, Ohio. The overmolded grip may be formed with a smooth outer surface or with a textured outer surface and provides a non-slip rubber (or rubber-like) gripping surface for the operator's hand to grasp. Preferably, the operator will grip the ends 14*c* of the handle 14 with his or her palm covering the grip 88 on the upper handle portion 14*a* and his or her fingers and thumb wrapping around the handle to grasp the grip 88 on the lower handle portion 14*b*. Alternatively, however, the operator may grasp the handle along any of the plurality of locations about the U-shaped handle. Furthermore, in alternate embodiments of the invention, additional portions of the handle 14 (or the entire handle) may be covered with an elastomer overmolding. For example, an overmolded grip portion may be included in the rear of the unit near the actuator switch.

It should be understood that other materials may be used for the overmolded gripping portions 88. For example, other thermal plastic elastomers or elastomer/plastic blends, such as rubber, nylon, butyl, EPDM, poly-trans-pentenarmer, natural rubber, butadiene rubber, SBR, ethylene-vinyl acetate rubber, acrylate rubber, chlorinated polyethylene, neoprene and nitrile rubber, may also be used for the overmolded grip 88. Another material which may be used for the overmolded grip 88 is HERCUPRENE, which is manufactured by the J-Von company of Leominster, Mass.

It should also be understood that alternate embodiments of the apparatus may be provided with no elastomer overmolding whatsoever. For example, the tool 10 may be provided with a simple smooth or textured plastic handle created from a traditional plastic injection molding process. More particularly, in a preferred embodiment, the overmolded grip surfaces 88 of handle 14 are replaced with a textured surface such as Rawal#MT-11605, a mold texturization process provided by Mold-Tech/Rawal of Carol Stream, Ill. Similarly, other mold texturization processes may be used to create a variety of textured surfaces.

The handle 14 is connected to the upper and lower housing shells 20 and 22 of the housing 12 by three spoke-like members 62*a, b* and *c*. The spokes 62*a–c* are generally rectangular in cross-section and have a generally hollow interior to conserve on material cost and reduce the overall weight of the tool 10. The preferred spokes 62*a–c* extend integrally from the upper and lower housing shells 20 and 22 of the housing 12 and, thus, are separated into upper and lower portions 64*a–c* and 66*a–c* separated by parting line 24. The upper spoke portions 64*a–c* are integrally connected to upper housing shell 20 and upper handle portion 14*a*, and the lower spoke portions 66*a–c* are integrally connected to lower housing shell 22 and lower handle portion 14*b*. Furthermore, as with the upper and lower housing shells 20 and 22 and the upper and lower handle portions 14*a* and 14*b*, the upper and lower spokes 64*a–c* and 66*a–c*, respectively, are preferably mated with a tongue and groove configuration along the part line 24.

As illustrated in FIGS. 5, 6, 8 and 10, an actuator, such as a rocker switch 90, is positioned at the top of the middle spoke 62*b*, which is centrally located in the rear of the tool 10 adjacent the handle 14. A switch cover 92 is positioned over the top of the switch 90 and encloses the switch 90 in order to prevent dust or other residual particles from interfering with the switch's operation. The switch cover is preferably a rubber cover.

The switch 90 snaps into a mounting plate 91, which, in turn, is fastened to the tool 10 by screws 93 or other similar fasteners. More particularly, the switch cover 92 is sandwiched between the switch 90, the mounting plate 91 and the inner surface of the bridging member 62*b*. In order to reduce accidental or inadvertent operation of the tool 10, the switch 90 is bounded on two sides by wall-like structures 96, which extend upward from the rear portion of the spoke (behind the switch 90) and to the sidewalls of the housing 12 (in front of the switch 90). The wall-like structures 96 preferably are formed integral with the spoke portion 62*b* and the housing 12. In alternate embodiments, the same function would be achieved by extending the side walls or wall-like structures 96 from the handle 14 to the sidewalls of the housing 12, or by recessing the switch 90 further into the spoke 62*b*.

Figure 18:
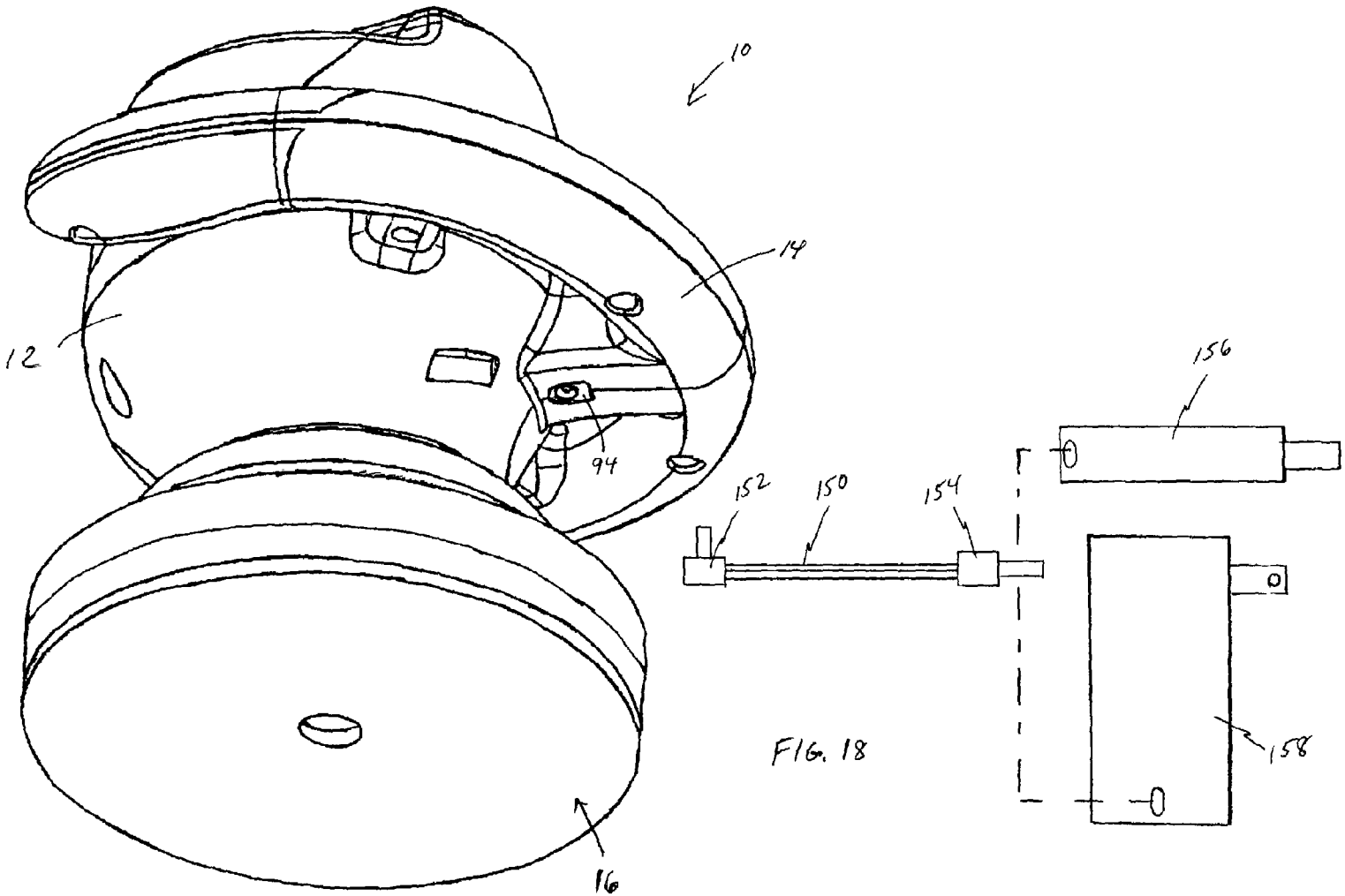
FIG. 18 is a perspective view of an alternate power tool in accordance with the invention showing a modular power cord.
Figure 19:
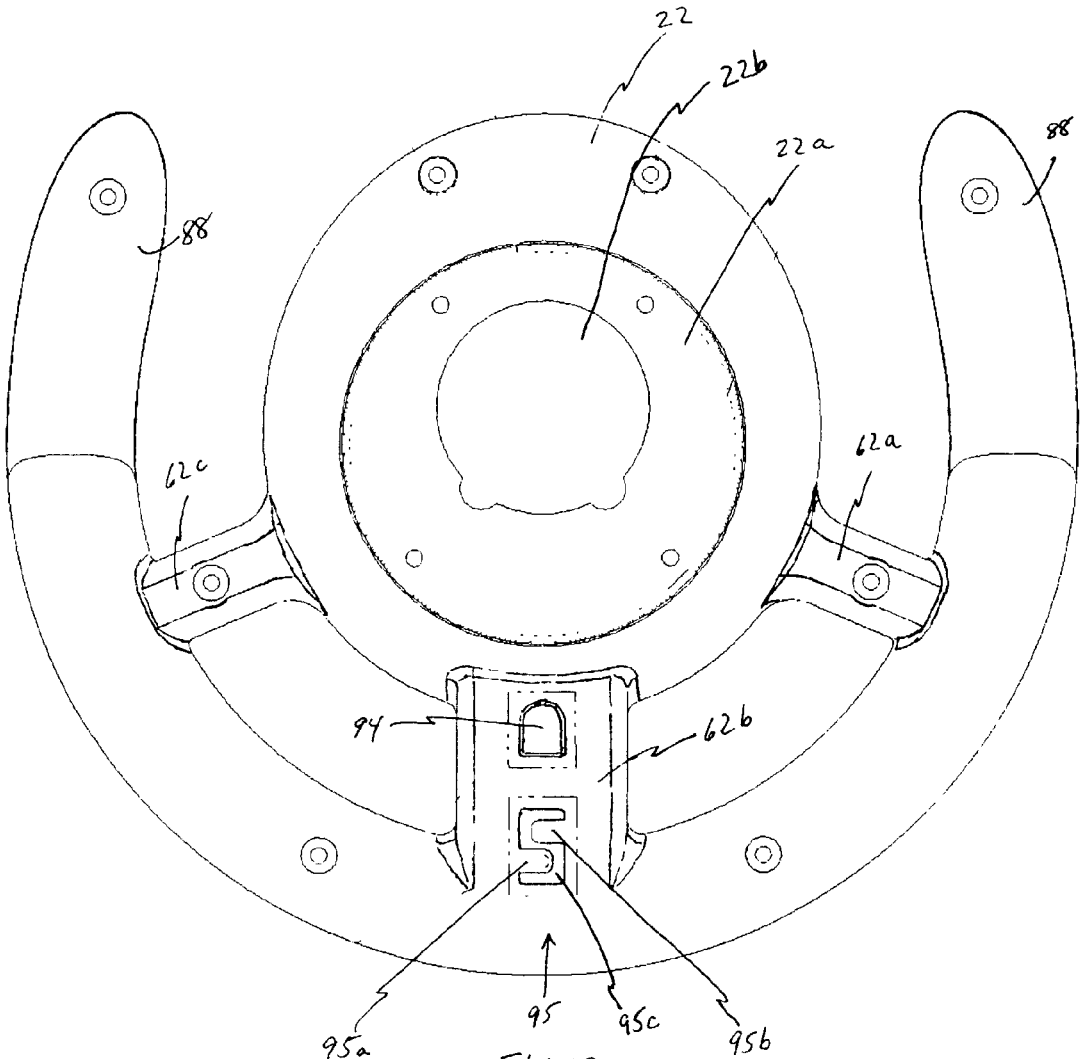
FIG. 19 is a bottom view of the power tool of FIG. 1.

As illustrated in FIGS. 6, 8 and 19, the rear spoke 62*b* includes a power connector 94, such as a jack, for supplying an alternate means of power to the tool 10, (i.e., for supplying power to the apparatus from a power supply external to the power tool). The rear spoke 62*b* also includes a strain relief 95 comprised of two tab members 95*a* and 95*b* partially covering a recess 95*c* and defining an S-shaped opening into the recess 95*c*. A power cord can be fed into the recess 95*c* through the S-shaped opening and held in the recess 95*c* by the tabs 95*a* and 95*b* to prevent the power cord from accidentally being disconnected from the connector 94. One end of the power cord includes a plug that fits complementarily into the connector 94 so that the tool 10 may continue to be used even when the power source 46 is dissipated. The various alternate power supplies and ways in which the apparatus can be connected thereto will be discussed further below with respect to FIG. 18; however, regardless of which power supply is used, the switch 90 will be electrically connected between the motor 28 and the power supply of choice. Thus, when the switch 90 is placed into the "on" position, power will be supplied to the motor 28 in order to drive the work element 16 connected to the tool 10. When the switch 90 is placed into the "off" position, no power will be supplied to the motor 28, and the apparatus will remain in an inoperative state.

The hollow configuration of the body 12, spokes 62*a–c* and handle 14 allow for a variety of alternate embodiments to be made. For example, in one alternate embodiment, the actuator 90 may be located in either of the other spokes 62*a* and 62*c* or in a portion of the handle 14. In another embodiment, the connector 94 for the external power supply may be located on the housing 12 or handle 14 of the tool 10.

The lower end of the gear shaft 36 extends into the shield member 74 and is threaded into a first threaded bore 38*a* defined by the counterweight 38. The counterweight 38 is connected to the pad assembly 78 by a bolt 80, which threads into a second bore 38*b* in the counterweight 38. The second counterweight bore 38*b* is parallel to, and located generally adjacent to, the first counterweight bore 38*a*. Thus, rotation of the gear shaft 36 results in a corresponding rotation in the counterweight 38 and the pad assembly 78 connected thereto. The pad assembly 78 preferably consists of a pad support 78*a*, a first pad 78*b*, a second pad 78*c* and a third pad 78*d*. The pads 78*b–d* are overlaid and connected to one another and to the pad support 78*a* by an adhesive and, preferably, include a closed polyethylene pad, an ether foam pad, and a closed micro-cell polyethylene pad, respectively.

The pad support 78*a* has a generally planar disc portion 78*e* supporting a frusto-conical portion 78*f* extending upward from the middle and an annular wall 78*g* extending upward from the disc portion 78*e*, about the frusto-conical portion 78*f*. The annular wall 78*g* is positioned intermediate of the outer periphery of the disc 78*e* and the frusto-conical portion 78*f*and, preferably, about two-thirds of the radial distance from the center of the disc 78*e* toward the periphery of the disc 78*e*. Thus, the counterweight 38 will rotate within the annular wall 78*g* of the pad support 78*a*, and the annular wall 78*g* remains under cover of the shield 74. The skirt member 74 and the annular wall 78*g* of the pad support 78*a* combine to prevent direct access to the counterweight 38.

The frusto-conical portion 78*f* of pad support 78*a* has a hollow center region that houses the bearings 40*c* and 40*d* and a spacer 98. The bolt 80 passes through the central openings in the bearings 40*c* and 40*d* and the spacer 98 and is threaded into the second bore 38*b* of the counterweight 38. The first pad 78*b*, the second pad 78*c* and the third pad 78*d* also have central openings or passageways through which the bolt 80 passes in order to be threaded into the counterweight 38. The end of bolt 80 includes an enlarged head to secure the pad assembly 78, including bearings 40*a* and 40*b* and spacer 98, to the tool 10. During operation, the pad 14 will be orbitally rotated about the z-axis of the tool (defined by gear shaft 36) when the motor drives the shaft 36 and the counterweight 38.

For maintenance purposes, for example, at least one small opening or notch 78*h* is defined by the annular wall 78*g* of the pad support 78*a* so that a hand tool or other instrument can be inserted into the interior region between the pad support 78*a* and the skirt member 74 to prevent the counterweight 38 from rotating while the bolt 80 is being unscrewed and removed from the counterweight 38. This enables the pad assembly 78 to be removed from the tool 10 for access to the counterweight 38, the screws and bolts connecting the skirt member 74 and the other internal components (e.g., the gear/motor mount 30) in the housing 12. Such access may be required to repair or replace parts, including the pad assembly 78 or those parts internal to the housing 12, the spokes 62*a–c* and the handle 14.

Turning now to FIGS. 11–17, there is illustrated an alternate embodiment of tool 10 embodying features in accordance with the present invention. The release mechanism for the power source may be incorporated as part of the power source as opposed to the housing 12 as illustrated in FIGS. 1–10. For convenience, features of the alternate embodiment illustrated in FIGS. 11–16 that correspond to features already discussed with respect to the embodiment of FIGS. 1–10 are identified using the same reference numeral in combination with an apostrophe (') merely to distinguish one embodiment from the other, but otherwise such features are equivalent.

More specifically, the power source 46*c*' includes the release mechanism 100. The release mechanism 100 is located on the top of the power source 46' adjacent the battery pack cover 46*c*' and the power source compartment parting line 50'. The mechanism 100 is a depressable button or paddle portion 100*a*, which, when pressed, causes a leg of a resilient release member 100*b* to bow a sufficient amount to release a clip 100*c* attached to the leg from engagement with a lock surface or lip 100*d* formed on the housing 12'. The power source 46' is secured to the housing 12' using an alternate tongue member or post 86' (FIG. 16) consisting of a hook or clip portion which is inserted into a mating recess on the housing 12'. The post 86' serves the same function as its corresponding part in FIGS. 1–10, which is to help secure and/or align the power source 46' with the housing 12'. The clip is tapered and the recess is beveled in order to make insertion and removal of the post 86' easier to accomplish.

To assist in removing the power source 46', the mechanism 100 has a recessed area 100*r* located at the paddle portion 100*a* to allow the operator to more easily grip and actuate the release mechanism 100. For example, an operator may palm the cover of the power source 46', or grasp the lip portions 54' with his or her thumb and pinky finger and grip and actuate the release mechanism 100 via the recessed portion 100*r* with his or her index finger, middle finger and/or ring finger. Thus, the operator is able to "feel" when his or her fingers are in the correct position by locating the recessed portion 100*r*. Alternatively, the operator may remove the battery pack 46' by using two hands. This configuration also allows the operator to actuate the release mechanism in the same direction the power source 46' is to be removed. Thus, the power source 46' can be removed in one general motion of pressing down and pulling the power source 46' toward the front of the tool 10.

With reference to FIGS. 17A–D, alternate release mechanisms may be used instead of the sliding switch or push button release mechanisms discussed above. For example, the release mechanism may consist of an alternate sliding switch 102*a*, a compressible clip 102*b*, locking clips 102*c*, latch 102*d* or other like structures. Thus, it should be understood that a variety of different release mechanisms may be used in order to release the power source from the housing.

In other alternate embodiments, the housing cover may be separate and distinct from the removable power source so that removal of the power source does not remove a portion of the housing 12. For example, a portion of the housing located about the power source may operate like a hinged door giving an operator access to the power source and its compartment. Alternatively, a portion of the housing may operate as a removable panel, which can be temporarily separated from the housing to provide access to the power source and its compartment. With either of these configurations, the portion of housing 12 that is moved to gain access to the power source compartment may be replaced on the tool with or without the power source installed.

Referring now more specifically to the wiring of the apparatus 10, it will be noted that the embodiments illustrated use a direct current (DC) configuration for supplying power to the power tool. For example, the battery pack 46 is electrically connected to one terminal of the motor 28 and electrically connected to one terminal of the switch actuator 90. Another terminal of the switch actuator 90 is electrically connected to the motor 28 so that DC power will be supplied to the motor 28 by turning on the actuator 90. The apparatus 10 is further wired to include DC jack 94 which allows the apparatus 10 to be operated using an alternate power supply which is electrically connected to jack 94. The alternate power supply may be another DC power supply (e.g., a 3–25 V power supply) such as a 12 V car battery or generator, or may be an alternating current (AC) power supply (e.g., a 85–265 V power supply), which is connected to a AC-DC converter (or adapter) for converting the AC power into DC power. For example, as illustrated in FIG. 18, a power cord 150 may be connected between the DC jack 94 via plug 152 and a DC or AC supply via plug 154. More particularly, plug 154 may be connected to a cigarette lighter adapter (CLA) 156 which, in turn, is connected to a DC power supply such as a 12 V battery. Alternatively, plug 154 maybe connected to an AC adapter 158 which is connected to an AC power supply, such as a conventional wall outlet in a residence, and converts the AC power to DC power via a AC-DC adapter.

Preferably, the apparatus 10 is wired such that the power source 46 can be charged in the housing 12 while the tool is connected to an alternate power supply via power cord 150. In addition, a charger (not shown) and extra power source can be supplied with the tool 10, so that one portable power source can be re-charged while the other portable power source is installed in the housing 12. Thus, when the installed power source becomes dissipated, the operator may continue to use the tool in a cordless fashion by inserting the second power source in the housing and placing the dissipated battery in the charger. The charger may be a separate component or may be connected to one of the power cord 150, CLA 156, and AC adapter 158.

Alternatively, the tool 10 may use an AC configuration in which an AC socket or terminal is located on the tool in place of the DC jack so that a power or extension cord can be connected between the apparatus 10 and an alternate AC power supply. The AC terminal located in the housing is electrically connected to a AC-DC converter located within the housing 12 in order to convert the AC power input into DC power which is supplied to the motor 28 to drive a working element, such as the pad 16. Similar to the configuration discussed above, the tool may be setup to charge the power source in the housing while the tool is plugged into the AC power supply, or charge the power source in an external charger while operating the apparatus using an alternate power supply.

Thus, it is apparent that there has been provided, in accordance with the invention, a portable power tool having a removable power source associated with the housing of the tool that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A power tool for working on a workpiece comprising:

a housing;

a motor located in the housing;

a working element being mechanically connected to the motor and driven by the motor to work on a workpiece;

a handle being connected to the housing in at least one position for maneuvering the power tool; and a removable portable power source having a first position wherein the power source is located at least primarily in the housing and being connected electrically to the motor to provide power to the motor for driving the working element and a second position wherein the power source is located remotely from the housing and detached electrically from the motor.

2. A power tool in accordance with claim 1 further comprising a lock associated with the housing and the removable portable power source, the lock having a lock position that prevents the removable portable power source from unintentionally becoming separated from the power tool and an unlock position that enables the removable portable power source to be removed from the housing and separated from the power tool.

3. A power tool in accordance with claim 2 wherein the lock is connected to the housing and remains connected to the housing when the removable portable power source is removed from the housing and separated from the power tool.

4. A power tool in accordance with claim 2 wherein the lock is connected to the removable portable power source and remains connected to the removable portable power source when the removable portable power source is removed from the housing and separated from the power tool.

5. A power tool in accordance with claim 2 wherein the housing includes a detachable portion that when the lock is in the unlocked position the detachable portion detaches at least in part to enable the removable portable power source to be selectively removed from the housing and moved to the second position remote from the power tool.

6. A power tool in accordance with claim 5 wherein the detachable portion is attached to the removable portable power source and when the lock is in the unlocked position the detachable portion detaches entirely to enable the removable portable power source to be selectively removed from the housing and moved to the second position remote from the power tool.

7. A power tool in accordance with claim 1 wherein the removable portable power source is rechargeable so as to be reusable with the power tool.

8. A power tool in accordance with claim 1 further comprising an electrical connector electrically connected to the motor for enabling the motor to be powered by an alternate power source located externally of the power tool regardless of whether the removable portable power source is connected to the power tool.

9. A power tool in accordance with claim 8 further comprising a power cord that electrically interconnects the electrical connector and the alternate power source located externally of the power tool.

10. A power tool in accordance with claim 9 wherein the alternate power source is an alternate portable power source located externally of the power tool.

11. A power tool in accordance with claim 10 wherein the alternate portable power source is rechargeable.

12. A power tool in accordance with claim 9 further comprising a converter electrically connected between the alternate power source and the motor to convert the power output of the alternate power source from a first type of power to a second type of power for powering the motor.

13. A power tool in accordance with claim 12 wherein the converter is permanently attached to the power cord.

14. A power tool in accordance with claim 9 further comprising circuitry for drawing power from the alternate power source located externally of the power tool when the power cord electrically interconnects the electrical connector and the alternate power source and drawing power from the removable portable power source when the power cord is not electrically interconnecting the electrical connector and the alternate power source.

15. A power tool in accordance with claim 9 further comprising circuitry for recharging the removable portable power source with the power supplied from the alternate power source located externally of the power tool.

16. A power tool in accordance with claim 1 wherein the handle includes an outer elastomer surface to facilitate enhanced gripping for control over the power tool.

17. A power tool in accordance with claim 16 wherein the outer elastomer surface comprises an elastomer injected overmolding.

18. A power tool in accordance with claim 1 wherein the handle is generally U-shaped to allow an operator a range of locations about the housing to facilitate an effective two-handed grip to maintain control over the power tool.

19. A power tool in accordance with claim 1 for working on a workpiece comprising:

a housing;

a motor located in the housing;

a working element being mechanically connected to the motor and driven by the motor to work on a workpiece;

a handle being connected to the housing in at least one position for maneuvering the power tool wherein the handle has first and second end portions that are enlarged with respect to the remainder of the handle; and a removable portable power source having a first position wherein the power source is located at least primarily in the housing and being connected electrically to the motor to provide power to the motor for driving the working element and a second position wherein the power source is located remotely from the housing and detached electrically from the motor.

20. A power tool in accordance with claim 1 further comprising an actuator switch electrically connected to the motor for activating and deactivating the power tool.

21. A power tool in accordance with claim 20 wherein the actuator switch is connected to a bridging member which connects the handle and the housing of the power tool.

22. A power tool in accordance with claim 21 wherein the actuator switch is recessed in the bridging member connecting the handle and the housing of the power tool.

23. A power tool in accordance with claim 1 wherein the portable power source includes a cover portion which forms a part of the housing when the portable power source is in the first position.

24. A power tool in accordance with claim 23 wherein the cover portion of the portable power source defines a second handle to grasp and carry the portable power source.

25. A power tool in accordance with claim 24 wherein the second handle comprises a raised section of the cover portion.

26. A power tool for working on a workpiece comprising:

a housing having an external surface;

a motor located in the housing;

a working element being mechanically connected to the motor and driven by the motor to work on a workpiece;

a portable power source located at least primarily in the housing and being connected electrically to the motor to provide power to the motor; and a handle having first and second ends, the handle having a general U-shape and extending about the external surface of the housing and being connected to the housing in at least one position for providing an operator with a plurality of locations to maintain a two handed grip to maneuver the power tool.

27. A power tool in accordance with claim 26 for working on a workpiece comprising:

a housing having an external surface;

a motor located in the housing;

a working element being mechanically connected to the motor and driven by the motor to work on a workpiece;

a handle having first and second ends, the handle having a general U-shape and extending about the external surface of the housing and being connected to the housing in at least one position for providing an operator with a plurality of locations to maintain a two handed grip to maneuver the power tool, wherein the handle has enlarged ends which the operator may grasp to maintain better control of the power tool.

28. A power tool in accordance with claim 27 wherein the enlarged ends of the handle have a convex lower surface and are at least partially textured in order to provide increased gripping of the power tool.

29. A power tool in accordance with claim 26 wherein the handle is bowed in order to assist the operator in maintaining better control of the power tool.

30. A power tool in accordance with claim 26 further comprising a removable power source having a first position wherein the power source is located at least primarily in the housing and being electrically connected to the motor to provide power to the motor for driving the workpiece and a second position wherein the power source is located remotely from the housing and detached electrically from the motor.

31. A power tool in accordance with claim 30 wherein the removable power source includes a cover portion which forms a part of the housing when the removable power source is in the first position.

32. A power tool in accordance with claim 31 wherein the cover portion of the removable power source defines a second handle to grasp and carry the portable power source.

33. A power tool in accordance with claim 32 wherein the second handle comprises a raised section of the cover portion.

34. A power tool in accordance with claim 26 further comprising an electrical connector electrically connected to the motor for enabling the motor to be powered by an alternate power source located external to the power tool.

35. A power tool in accordance with claim 26 wherein the handle includes an outer elastomer surface to facilitate enhanced gripping for control over the power tool.

36. A power tool in accordance with claim 35 wherein the outer elastomer surface comprises an elastomer injected overmolding.

37. A power tool for working on a workpiece comprising:

a housing;

a motor located in the housing;

a working element being mechanically connected to the motor and driven by the motor to work on a workpiece; and a handle being connected to the housing in at least one position and having first and second end portions, the end portions being enlarged with respect to the remainder of the handle to facilitate better control of the power tool.

38. A power tool in accordance with claim 37 wherein the enlarged ends of the handle have a convex lower surface and are at least partially textured in order to provide increased gripping of the power tool.

39. A power tool in accordance with claim 37 wherein the handle is bowed in order to assist the operator in maintaining better control of the power tool.

40. A power tool in accordance with claim 39 wherein the handle is bowed into a general U-shape to allow an operator a range of locations about the housing to facilitate an effective two-handed grip to maintain control over the power tool.

41. A power tool in accordance with claim 37 further comprising a removable power source having a first position wherein the power source is located at least primarily in the housing and being electrically connected to the motor to provide power to the motor for driving the workpiece and a second position wherein the power source is located remotely from the housing and detached electrically from the motor.

42. A power tool in accordance with claim 41 wherein the removable power source includes a cover portion which forms a part of the housing when the removable power source is in the first position.

43. A power tool in accordance with claim 42 wherein the cover portion of the removable power source defines a second handle to grasp and carry the removable power source.

44. A power tool in accordance with claim 43 wherein the second handle comprises a raised section of the cover portion.

45. A power tool in accordance with claim 37 further comprising an electrical connector electrically connected to the motor for enabling the motor to be powered by an alternate power source located external to the power tool.

46. A power tool in accordance with claim 37 wherein the handle includes an outer elastomer surface to facilitate enhanced gripping for control over the power tool.

47. A power tool in accordance with claim 46 wherein the outer elastomer surface comprises an elastomer injected overmolding.

48. A power tool in accordance with claim 37 further comprising an actuator electrically connected to the motor for activating and deactivating the power tool, the actuator being disposed in a bridging member which connects the handle and the housing of the power tool.

49. A power tool for working on a workpiece comprising:

a housing;

a motor located in the housing;

a working element being mechanically connected to the motor and driven by the motor to work on a workpiece; and a handle having first and second ends, the handle extending about at least half the housing and being connected to the housing in at least one position for providing an operator with a plurality of locations to maintain a two handed grip to maneuver the power tool, the first and second ends of the handle being enlarged with respect to the remainder of the handle which the operator may grasp to maintain better control of the power tool.

50. A power tool in accordance with claim 49 wherein the enlarged ends of the handle have a convex lower surface and are at least partially textured in order to provide increased gripping of the power tool.

51. A power tool for working on a workpiece comprising:

a housing;

a motor located in the housing;

a working element being mechanically connected to the motor and driven by the motor to work on a workpiece;

a handle having first and second ends, the handle extending about at least half the housing and being connected to the housing in at least one position for providing an operator with a plurality of locations to maintain a two handed grip to maneuver the power tool; and a removable power source having a first position wherein the power source is located at least primarily in the housing and being electrically connected to the motor to provide power to the motor for driving the workpiece and a second position wherein the power source is located remotely from the housing and detached. electrically from the motor.

* * * * *

UNITED STATES PATENT AND TRADEMARK OFFICE

CERTIFICATE OF CORRECTION

PATENT NO. : 6,971,951 B2
APPLICATION NO. : 10/247209
DATED : December 6, 2005
INVENTOR(S) : Christopher T. Boyer et al.

It is certified that error appears in the above-identified patent and that said Letters Patent is hereby corrected as shown below:

Title page,
Item [12], change "Boyer" to -- Boyer et al. --.
Item [75], Inventor, add -- John T. Gerritsen, Carpentersville, IL (US) --.

Signed and Sealed this

Twenty-seventh Day of June, 2006

JON W. DUDAS
*Director of the United States Patent and Trademark Office*